US009128431B2

(12) United States Patent
Wagatsuma

(10) Patent No.: US 9,128,431 B2
(45) Date of Patent: Sep. 8, 2015

(54) IMAGE FORMING APPARATUS FOR FAILURE SUPPRESSION

(71) Applicant: Oki Data Corporation, Tokyo (JP)

(72) Inventor: Eiji Wagatsuma, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/311,862

(22) Filed: Jun. 23, 2014

(65) Prior Publication Data

US 2014/0376940 A1 Dec. 25, 2014

(30) Foreign Application Priority Data

Jun. 25, 2013 (JP) ..... 2013-132359

(51) Int. Cl.
*G03G 15/20* (2006.01)

(52) U.S. Cl.
CPC .... *G03G 15/205* (2013.01); *G03G 2215/00772* (2013.01)

(58) Field of Classification Search
CPC ..... G03G 15/205
USPC ..... 399/44, 45, 70
See application file for complete search history.

(56) References Cited

U.S. PATENT DOCUMENTS

| | | | | |
|---|---|---|---|---|
| 7,177,560 | B2 * | 2/2007 | Fujisawa | 399/44 |
| 7,260,333 | B2 * | 8/2007 | Shishikura | 399/44 |
| 7,809,294 | B2 * | 10/2010 | Hattori et al. | 399/44 |
| 2011/0081158 | A1 | 4/2011 | Wagatsuma | |

FOREIGN PATENT DOCUMENTS

JP 2011076019 A 4/2011

* cited by examiner

*Primary Examiner* — William J Royer
(74) *Attorney, Agent, or Firm* — Panitch Schwarze Belisario & Nadel LLP

(57) ABSTRACT

An image forming apparatus includes: a fixing member rotatably supported for heating a developer; a pressure member pressing a recording medium upon sandwiching the recording medium with the fixing member; a temperature detection unit for detecting temperature of the fixing member; a temperature control unit for controlling the temperature of the fixing member; a rotation control unit for controlling rotation of the fixing member; an environment value detection unit for detecting an atmosphere temperature; a time measure unit for measuring time necessary for finish of warming up of the fixing member; and a rotation time setting unit for setting rotation time of the fixing member, wherein the rotation time setting unit changes the rotation time from a timing that the fixing member reaches a warming up temperature, based on a lapse time result provided from the time measure unit, where the atmosphere temperature is lower than a prescribed temperature.

16 Claims, 20 Drawing Sheets

| CONTROL MODE | CODE NUMBER | ENVIRONMENTAL PARAMETER CONDITION | Ymax VALUE |
|---|---|---|---|
| OFF | 0 | — | NO SETTING |
| Mode 1 | 1 | 1～2 | 60 |
| Mode 2 | 2 | ANY | 90 |

FIG.16

| | HUMIDITY | | | | | | | | |
|---|---|---|---|---|---|---|---|---|---|
| TEMP. | <15 | 15≦<25 | 25≦<35 | 35≦<45 | 45≦<55 | 55≦<65 | 65≦<75 | 75≦<85 | 85≦ |
| <5 | 8 | 8 | 8 | 7 | 7 | 7 | 7 | 6 | 6 |
| 5≦<10 | 8 | 8 | 8 | 7 | 7 | 6 | 6 | 5 | 5 |
| 10≦<15 | 8 | 8 | 7 | 7 | 6 | 5 | 5 | 4 | 4 |
| 15≦<20 | 8 | 7 | 7 | 6 | 5 | 4 | 4 | 3 | 3 |
| 20≦<25 | 7 | 7 | 6 | 5 | 4 | 4 | 3 | 3 | 2 |
| 25≦<30 | 7 | 6 | 5 | 4 | 4 | 3 | 1 | 1 | 1 |
| 30≦<35 | 7 | 6 | 5 | 4 | 2 | 1 | 1 | 1 | 1 |
| 35≦<40 | 6 | 6 | 4 | 2 | 1 | 1 | 1 | 1 | 1 |
| 40≦ | 6 | 5 | 4 | 2 | 1 | 1 | 1 | 1 | 1 |

FIG.17

IMAGE FORMING APPARATUS FOR FAILURE SUPPRESSION

CROSS REFERENCE TO RELATED APPLICATION

This application claims priority benefits under 35 USC, section 119 on the basis of Japanese Patent Application No. 2013-132359, the disclosure of which is incorporated herein by reference.

BACKGROUND OF THE INVENTION

1. Field of the Invention

This invention relates to an image forming apparatus having a thermal fixing step in an image forming step done at such as, e.g., printers, facsimile machines, and photocopiers.

2. Background of Related Art

In conventional electrophotographic type image forming apparatuses such as, e.g., printers, facsimile machines, and photocopiers, developments are made by attaching toner as a developer to electrostatic latent images formed on a surface of a photosensitive drum as an image carrier. The developer images produced by the development step are transferred onto a recording medium and conveyed to a fixing unit.

The fixing unit generally includes a fixing roller having a heater as a thermal source, and a pressure roller nipping recording media together with the fixing roller with pressure. The recording media transferred with developer images are given with heat and pressure when passed through a nipping portion formed between the fixing roller and the pressure roller, thereby fixing the developer images on the recording media.

Some image forming apparatuses thus formed detect surface temperature of the pressure roller at a start timing of warming up of the apparatus, do warming up based on the detected results, and start printing operation (see, e.g. Japanese Patent Application Publication No. 2011-76019 (A1)).

With such a conventional apparatus, however, there raises a problem that warming up based only on the detected results tends to cause fixing failures at the printing initial stage or paper deformations or paper curling, even where warming up is made based on the detected results of the surface temperature of the pressure roller.

It is therefore an object of the invention to provide an image forming apparatus capable of suppressing occurrence of fixing failures and paper deformations even without any detection result of pressure roller's surface temperature.

SUMMARY OF THE INVENTION

To solve the above problems, an image forming apparatus according to the invention includes: a fixing member rotatably supported for heating the developer; a pressure member pressing the recording medium upon sandwiching the recording medium with the fixing member; a temperature detection unit for detecting temperature of the fixing member; a temperature control unit for controlling the temperature of the fixing member; a rotation control unit for controlling rotation of the fixing member; an environment value detection unit for detecting an atmosphere temperature; a time measure unit for measuring time necessary for finish of warming up of the fixing member; and a rotation time setting unit for setting rotation time of the fixing member. The rotation time setting unit changes the rotation time from a timing that the fixing member reaches a warming up temperature, based on a lapse time result provided from the time measure unit, where the atmosphere temperature is lower than a prescribed temperature.

According to the image forming apparatus of the invention, fixing failure and paper deformation are prevented from occurring even without any detection result of pressure roller's surface temperature.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 16 is a table for an example of the control mode according to the second embodiment of the invention;

FIG. 17 is a table for temperature versus humidity used for deciding environmental parameters according to the second embodiment of the invention;

DETAILED DESCRIPTION OF EMBODIMENTS

Figure 1:
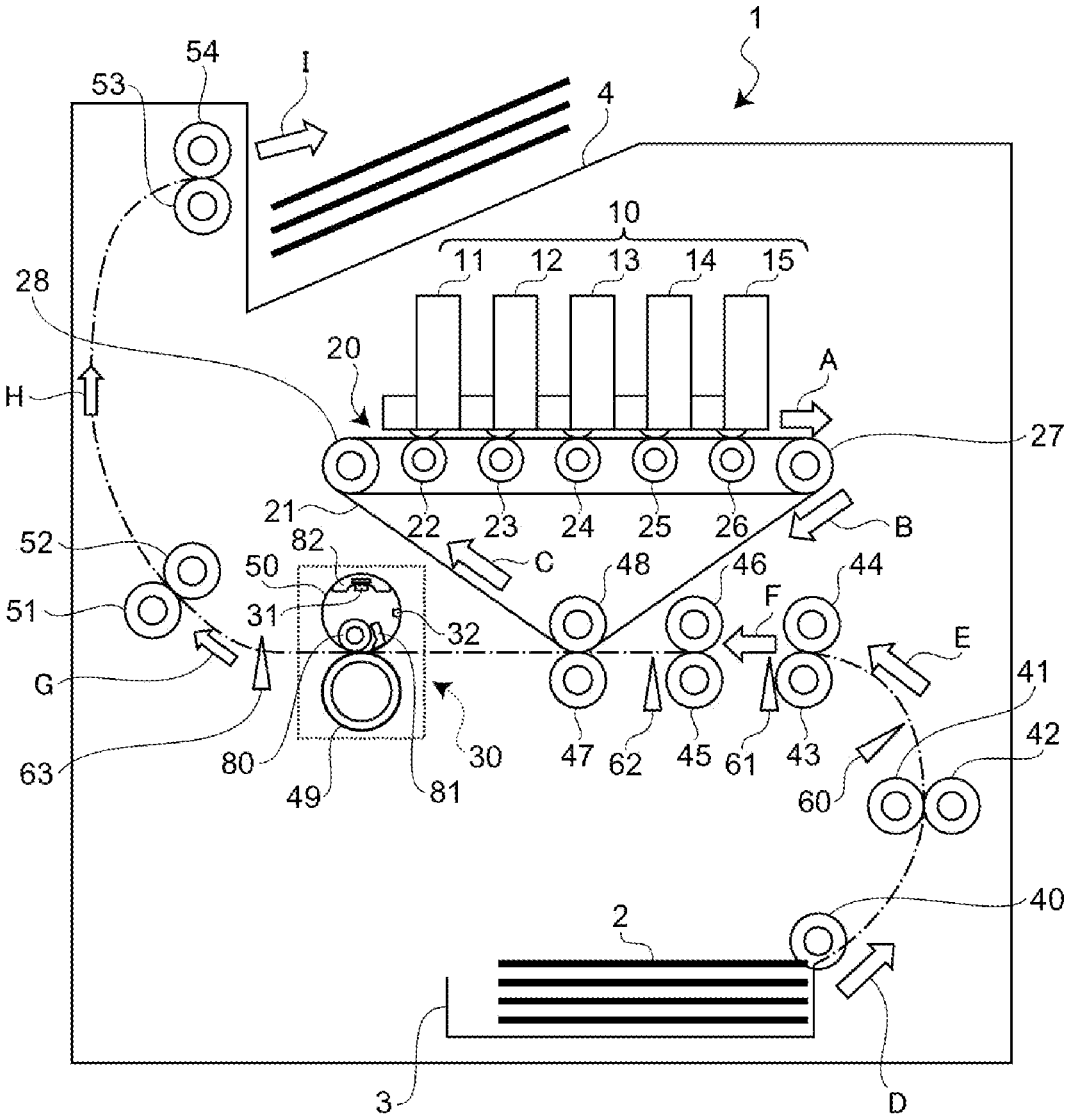
FIG. 1 is a schematic diagram showing an essential structure of a printer according to a first embodiment of the invention.

Hereinafter, referring to the drawings, an embodiment of the invention is described. It is to be noted that the invention is not limited to those described below and that the invention is modifiable as far as not deviated from the scope of the invention.

First Embodiment

In the description of the first embodiment, a structure of a printer 1 as an image forming apparatus according to the invention is described. The printer 1 is provided with plural electrophotographic type process units and is an image forming apparatus of an intermediate transfer type capable of printing, on a paper 2 as a recording medium, multicolor images based on printing data entered from an external terminal such as, e.g., a host computer.

FIG. 1 is a schematic diagram showing an essential structure of a printer 1 according to a first embodiment of the invention. The printer 1 includes a medium cassette 3 containing paper 2 not yet printed, a pickup roller 40 feeding the paper 2 in a direction of arrow D in FIG. 1, a pair of register rollers 41, 42 conveying the paper 2 fed from the pickup roller 40, a pair of conveyance rollers 43, 44 conveying the paper 2 as correcting skew, a pair of rollers 45, 46 further conveying the paper 2 conveyed with the conveyance rollers 43, 44 to a transfer belt unit 20, an electrophotographic process unit 10 forming developer images corresponding to respective developer colors, the transfer belt unit 20 for primarily transferring the developer images formed at the electrophotographic process unit 10 onto an intermediate transfer belt 21 and for secondarily transferring the developer images transferred onto the intermediate transfer belt 21 onto the paper 2, a fixing unit 30 fixing the developer images transferred onto the paper 2 from the transfer belt unit 20, a pair of conveyance rollers 51, 52 conveying the paper 2 conveyed with the fixing unit 30, a pair of delivery rollers 53, 54 delivering the paper 2 to the exterior of the printer 1, and a passage sensor 60, a passage sensor 61, a writing sensor 62, and a delivery sensor 63 for detecting passage of the paper 2.

The medium cassette 3 contains paper 2 inside in a stacking manner and is detachably attached to a lower portion of the printer 1. The pickup roller 40 is disposed above the medium cassette 3 for separating paper 2 sheet by sheet.

The register rollers 41, 42 are provided in pressurized contact with each other, rotate according to drive force transmitted from a drive power source, not shown, via a motor drive control unit 119 as described below, and convey the paper 2 fed from the medium cassette 3 in a direction of arrow E in FIG. 1.

The conveyance rollers 43, 44 are provided in pressurized contact with each other, rotate according to drive force transmitted from the drive power source, not shown, via the motor drive control unit 119, and convey the paper 2 in a direction of arrow F in FIG. 1 while correcting skew of the paper 2.

The rollers 45, 46 are provided in pressurized contact with each other, and rotate according to drive force transmitted from the drive power source, not shown, via the motor drive control unit 119. The rollers 45, 46 are arranged in immediately front of secondary transfer rollers 47, 48 provided in the transfer belt unit 20, and control timings of the secondary transfer by rotation and stop.

The electrophotographic process unit 10 includes five process units 11 to 15 for forming developer images corresponding to the respective developer colors. Each process unit 11 to 15 contains toner as a developer in each color and forms toner images as developer images based on the input printing data on a surface of a photosensitive drum described below. The process unit 11 according to this embodiment contains toner in special color such as white or clear; the process unit 12 contains toner in cyan; the process unit 13 contains toner in magenta; the process unit 14 contains toner in yellow; and the process unit 15 contains toner in black. The toner images corresponding to the respective colors are therefore formed on the photosensitive drum surface.

The transfer belt unit 20 is an intermediate transfer belt unit, makes a primary transfer of the toner images formed at the electrophotographic process unit 10 onto the intermediate transfer belt 21, and makes a secondary transfer of the toner images transferred on the intermediate transfer belt 21 to the paper 2. The transfer belt unit 20 thus formed includes the intermediate transfer belt 21, primary transfer rollers 22 to 26 for making primary transfer onto the intermediate transfer belt 21 for the toner images formed on the photosensitive drum surface arranged at each process unit 11 to 15 of the electrophotographic process unit 10, and secondary transfer rollers 47, 48 for making secondary transfer onto the paper 2 for toner images transferred onto the intermediate transfer belt 21.

The intermediate transfer belt 21 is an endless belt member tensioned with rollers 27, 28 and the secondary transfer roller 48. When making the primary transfer, the intermediate transfer belt 21 drives in arrows A, B, and C directions in FIG. 1 as respective rollers rotate, based on control done by a transfer belt drive control unit 300 described below.

The primary rollers 22 to 26 are provided in pressurized contact with the respective photosensitive drums mounted in respective process units 11 to 15 of the electrophotographic process unit 10 via the intermediate transfer belt 21. The primary rollers 22 to 26 are biased with a prescribed transfer voltage given from a high voltage power source 303 based on control done by a transfer control unit 302 described below. The toner images formed on the respective surfaces of the photosensitive drums are transferred onto the intermediate transfer belt 21 with the transfer voltage.

The secondary rollers 47, 48 are provided in pressurized contact with each other via the intermediate transfer belt 21. The secondary rollers 47, 48 are biased with a prescribed transfer voltage from the high voltage power source 303 based on control done by the transfer control unit 302 described below, and the toner images transferred onto the intermediate transfer belt 21 are further transferred onto the paper 2 at a timing that the paper 2 passes through a nipping portion formed between the secondary transfer rollers 47, 48.

The fixing unit 30 is incorporated with a fixing belt 50 and a pressure roller 49, which are arranged in pressurized contact with each other. The fixing unit 30 makes fixing of the toner images transferred onto the paper 2 in applying heat and pressure. A temperature detection element 31 and a temperature detection element 32 are temperature detection devices such as a thermistor for detecting temperature of a back surface of a planar heater 83 and temperature of an inner side of the fixing belt 50, as described below, respectively. It is to be noted that in this embodiment there is no temperature detection device detecting the surface temperature of the pressure roller 49. A detailed structure of the fixing unit 30 is described below.

The conveyance rollers 51, 52 are provided in a pressurized contact with each other, rotate by drive force transmitted from a drive power source not shown via the motor drive control unit 119 described below, and convey, in a direction of arrow H in FIG. 1, the paper 2 conveyed in a direction of arrow G in FIG. 1 by the fixing unit 30.

The delivery rollers 53, 54 are provided in a pressurized contact with each other, rotate by drive force transmitted from a drive source, not shown, via the motor drive control unit 119 described below, and convey the paper 2 conveyed from the conveyance rollers 51, 52 in a direction of arrow 1 in FIG. 1 to deliver the paper 2 to a stacker 4 formed in utilizing the apparatus body.

The passage sensors 60, 61, the writing sensor 62, and the delivery sensor 63 are mechanical sensors detecting passages of the paper 2, and operate mechanically and electronically at each passage of the paper 2. When the paper 2 passes by, the passage sensors 60, 61, the writing sensor 62, and the delivery sensor 63 output detection results to a control unit 106 described below.

Figure 2:
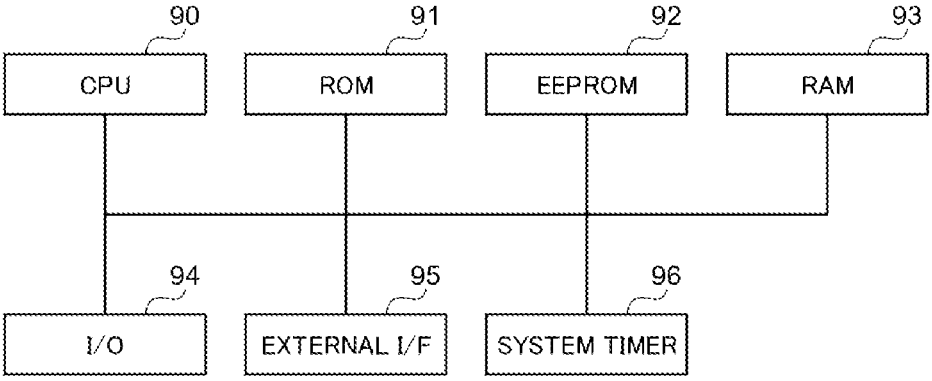
FIG. 2 is a block diagram showing a system structure of the printer according to the first embodiment of the invention.

Next, a system structure of the printer 1 is described. FIG. 2 is a block diagram describing the system structure of the printer 1 according to this embodiment.

As shown in FIG. 2, the printer 1 includes a CPU (Central Processing Unit) 90, a ROM (Read Only Memory) 91, an EEPROM (Electrically Erasable Programmable Read Only Memory) 92, a RAM (Random Access Memory) 93, an I/O 94, an external I/F 95, and a system timer 96.

The CPU 90 is an operation device reading out programs stored in the ROM 91 and realizing the functions of the printer 1 by executing the programs.

The ROM 91 is a memory for reading out, storing the programs executed by the CPU 90.

The EEPROM 92 is a ROM rewritable with the CPU 90 and is made of, e.g., a non-volatile memory storing such as device setting information. The RAM 93 is a volatile memory capable of temporarily reading out and rewriting data with the CPU 90 and is mainly used as a working area of the CPU 90.

The I/O 94 is an input and output port controlling inputs and outputs of devices such as, e.g., sensors and motors.

The external I/F 95 is an interface controlling transmissions of printing data and control commands between the printer 1 and the host computer demanding printing.

The system timer 96 is a clock timer operated with a system clock signal and is used for displaying day and time and for retrieving the present time.

Figure 3:
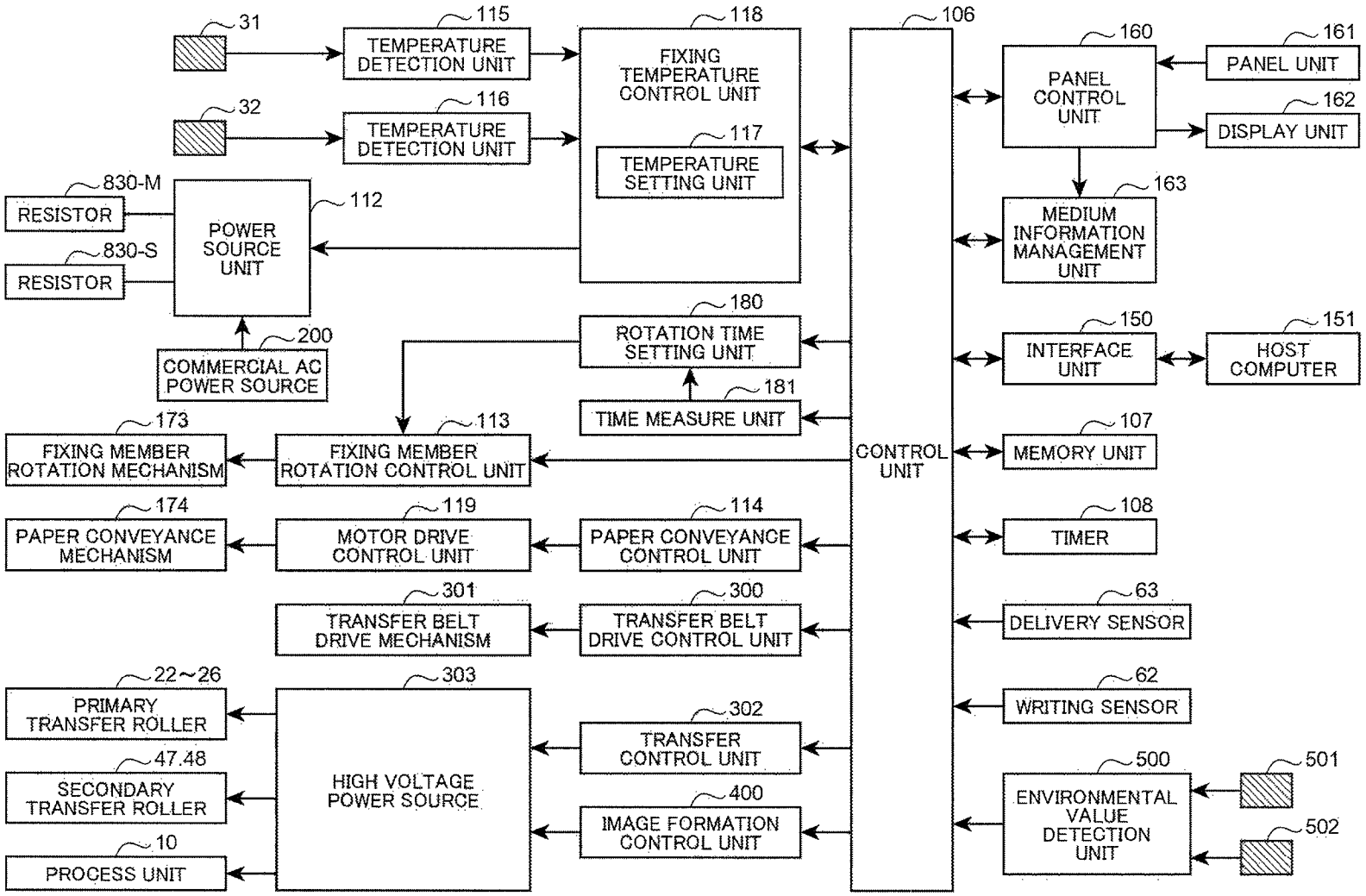
FIG. 3 is a block diagram showing a functional structure of the printer according to the first embodiment of the invention.

Next, a functional structure of the printer 1 is described. FIG. 3 is a block diagram showing the functional structure of the printer 1 according to this embodiment.

The control unit 106 controls a fixing temperature control unit 118, a panel control unit 160, a medium information management unit 163, an interface unit 150, a paper conveyance control unit 114, a time measure unit 181, and a timer 108. The control unit 106 can store information from a temperature setting unit 117 provided in the fixing temperature control unit 118, the panel control unit 160, the medium information management unit 163, the interface unit 150, the paper conveyance control unit 114, and the timer 108, to a memory unit 107 according to the necessity.

The fixing temperature control unit 118 serving as a temperature controller obtains a back side temperature of the planer heater 83 and an inner side temperature of the fixing belt 50 using a temperature detection unit 115 and a temperature detection unit 116. The fixing temperature control unit 118 outputs a heater control signal to a power source unit 112 during rotation of the fixing belt 50 so as to render the inner side temperature of the fixing belt 50 come close to a target fixing temperature as a control target temperature Tg in temperatures set with the temperature setting unit 117, based on the inner side temperature of the fixing belt 50 obtained via the temperature detection unit 116.

The temperature setting unit 117 sets the control target temperature Tg and the warming up end temperature Te. In this embodiment, the control target temperature Tg is set to 165 Celsius degrees whereas the warming up temperature Te is set to 160 Celsius degrees.

The temperature detection unit 115 detects the back side temperature of the planer heater 83 according to the output of the temperature detection element 31 and outputs temperature information to the fixing temperature control unit 118. The temperature detection unit 116 detects the inner side temperature of the fixing belt 50 from the output of the temperature detection element 32 and outputs the temperature information to the fixing temperature control unit 118.

The power source unit 112 receives input of the heater control signal from the fixing temperature control unit 118, and energizes resistors 830-M, 830-S included in the planer heater 83 described below by flowing currents supplied from a commercial AC power source 200 based on the control signal.

A fixing member rotation control unit 113 as a rotation control unit controls rotation of a fixing member rotation mechanism 173 based on the control of a rotation time setting unit 180. It is to be noted that the fixing member rotation mechanism 173 means the whole of fixing member rotation mechanisms rotationally driving during the fixing step such as, e.g., a fixing roller 80, the pressure roller 49, and the fixing belt 50 tensioned with the fixing roller 80, a pressure pad 81, and a heat dissipation member 82, as shown in FIG. 1.

The rotation time setting unit 180 drives the fixing member rotation control unit 113 based on idling time of the fixing member rotation control unit 113 set with the control unit 106. The time measure unit 181 reads out, from the timer 108, a lapse time from the start of warming up operation of the fixing belt 50 to the end of the operation.

The paper conveyance control unit 114 receives input of the paper conveyance signal from the control unit 106 and outputs a drive signal to the motor drive control unit 119. A paper conveyance mechanism 174 operates as to convey the paper 2 in a prescribed direction according to the drive signal outputted from the motor drive control unit 119. It is to be noted that the paper conveyance mechanism 174 means the whole of conveyance mechanisms relating to conveyance of the paper 2 such as the pickup roller 40, the register rollers 41, 42, the conveyance rollers 43, 44, the rollers 45, 46, the conveyance rollers 51, 52, and the delivery rollers 53, 54, as shown in FIG. 1.

The transfer belt drive control unit 300 receives input of a belt drive signal from the control unit 106, and drives a transfer belt drive mechanism 301. It is to be noted that the transfer belt drive mechanism 301 means the whole of drive mechanisms relating to tension of the intermediate transfer belt 21 and to drive of the intermediate transfer belt 21 such as the roller 27, the roller 28, and the secondary transfer roller 48, as shown in FIG. 1.

The transfer control unit 302 receives input of the transfer control signal from the control unit 106, and outputs the control signal to the high voltage power source 303. The high voltage power source 303 to which the control signal is entered, applies transfer voltages to the primary transfer rollers 22, 23, 24, 25, 26 and the secondary transfer rollers 47, 48. In this embodiment, for example, the transfer voltage is around 1 kV to 3 kV.

Figure 4:
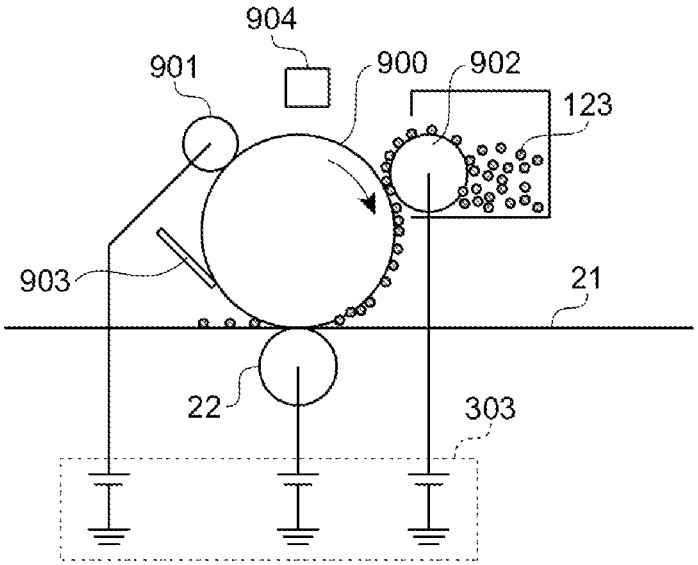
FIG. 4 is an illustration showing a structural example of a process unit according to the first embodiment of the invention.

An image formation control unit 400 receives image forming control signal from the control unit 106 in the same way as the transfer control unit 302 and outputs the control signal to the high voltage power source 303. The high voltage power source 303 to which the control signal enters, applies voltages to the respective rollers included in the process units 11 to 15 of the electrophotographic process unit 10 to form toner images. Referring to FIG. 4, an image forming process using an electrophotographic method in each process unit 11 to 15 is described herein.

FIG. 4 is a diagram, illustrating a structural example of the process units 11 to 15. The process units 11 to 15 according to this embodiment only have different toners to be contained, and other structures are the same among the process units 11 to 15. Accordingly, the process unit 11 and the primary transfer roller 22 provided in pressurized contact with a photosensitive drum 900 included in the process unit 11, are described herein.

The process unit 11 is formed with a charge roller 901, a developing roller 902, and a cleaning blade 903, around the photosensitive drum 900 serving as an electrostatic latent image carrier using an organic photosensitive body formed in a drum shape, from an upstream side to a downstream side in a rotation direction (arrow direction in FIG. 2) of the photosensitive drum 900. An exposure unit 904 made of, e.g., an LED head having light emission elements such as LEDs (Light Emitting Diodes) and a lens array is arranged immediately above the photosensitive drum 900. The exposure unit 904 is provided at a position such that emitted light out of the LED elements based on the printing data is focused on a surface of the photosensitive drum 900.

The photosensitive drum 900 is structured of a conducting supporting body and a photoconductive layer, and is an organic photosensitive body made of, e.g., sequentially, a charge generation layer and a charge transport layer as the photoconductive layer on a metal shaft such as aluminum serving as the conducting supporting body.

The charge roller 901 is a roller member made of, e.g., a metal shaft and semiconductive epichlorohydrin rubber. The charge roller 901 is in contact or pressurized contact with photosensitive drum 900, and charges uniformly the surface of the photosensitive drum 900 based on the bias voltage given from the high voltage power source 303. For example, when the charge roller 901 is biased at −1050 V, the surface of the photosensitive drum 900 is charged at approximately −500 V with adjacent discharge. The portion exposed with the exposure unit 904 is biased at, e.g., approximately −50 V.

The developing roller 902 is made of, e.g., a urethane rubber dispersed with carbon black formed on an outer periphery of a metal shaft such as a stainless steel, and the surface is treated with an isocyaninate processing. The developing roller 902 is arranged in pressurized contact with the surface of the photosensitive drum 900, supplies toner 123 charged with a developing voltage and triboelectrically charged, to electrostatic latent images formed based on emission light emitted out of the exposure unit 904, and develops the toner images. The developing voltage applied to the developing roller 902 is, e.g., approximately −200 V, and the toner 123 is attached to the surface of the photosensitive drum 900 according to a relationship between an electric potential of the toner 123 and an electric potential of surface portions of the photosensitive drum 900 exposed with the exposure unit 904.

The cleaning blade 903 is made of a holding bracket to which a rubber such as urethane rubber is securely attached with an adhering method such as hot melt. The cleaning blade 903 is arranged in contact with the surface of the photosensitive drum 900 to treat the remaining toner 123 on the surface of the photosensitive drum 900 in a scraping manner.

As described above, the primary transfer roller 22 is biased with the prescribed transfer voltage from the high voltage power source 303 based on control done by the transfer control unit 302, so that the toner images formed on the surfaces of the respective photosensitive drums 900 are transferred onto the intermediate transfer belt 21 with the transfer voltage.

Thus, multicolor toner images can be formed on the intermediate transfer belt 21 by performing image forming processes of the electrophotographic method from the process unit 11 to the process unit 15 sequentially.

Returning to FIG. 3 again, the panel control unit 160 outputs manipulation information entered by a user via a panel unit 161, to the control unit 106, and output display information based on information entered by the user, to a display unit 162. The display unit 162 displays information such as letters and pictures for user's entry. The display unit 162 may be a display device as represented with, e.g., liquid crystal devices and LED devices.

Figure 5:
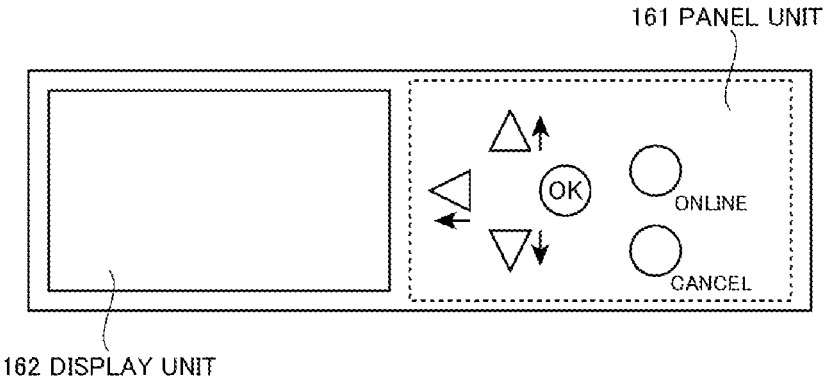
FIG. 5 is a schematic diagram showing an example of a display panel having a panel portion and a display portion according to the first embodiment of the invention.

FIG. 5 is an example of a structural example of the display panel having the panel unit 161 and the display unit 162. In this embodiment, the display unit 162 is made of a liquid crystal device, and the panel unit 161 is formed with various buttons arranged thereon. The arrow keys of the panel unit 161 are assigned with respective entry keys, and are corresponding to manipulations of a cursor, not shown, of the display unit 162. Buttons of "OK," "ONLINE," and "CANCEL" are assigned as respective entry keys and used for manipulations for such as "save" and "cancel."

The medium information management unit 163 shown in FIG. 3 manages medium information, inter alia, information on the paper 2 as the manipulation information of the panel unit 161 manipulated by the user, such as, e.g., medium size, medium thickness, medium type, medium weight (weight per unit). The control unit 106 can read out the medium information managed at the medium information management unit 163.

The interface unit 150 receives printing data from a host computer 151 and can output the data to the control unit 106. The interface unit 150 is also an interface that can transmit the information of the control unit 106 to the host computer 151. As the interface unit 150, hardware resources such as wired LAN (Local Area Network), wireless LAN, USB (Universal Serial Bus), and Centronics interface can be used.

The memory unit 107 is a memory device such as the EEPROM 92 and the RAM 93 for storing medium information read out of the medium information management unit 163.

The timer 108 is a timer for measuring prescribed times.

The writing sensor 62 is a mechanical sensor for rendering the control unit 106 recognize the position of the paper 2 immediately before the secondary transfer. The delivery sensor 63 is a mechanical sensor for rendering the control unit 106 recognize the position of the paper 2 passing by the fixing unit 30.

An environmental value detection unit 500 is a unit detecting atmosphere temperature and atmosphere humidity as temperature and humidity around the printer 1 based on signals obtained from a temperature sensor 501 and a humidity sensor 502 as a humidity detection device. It is to be noted that the control unit 106 can read out environment data (atmosphere temperature and atmosphere humidity) detected with the environmental value detection unit 500 when necessary.

Figure 6:
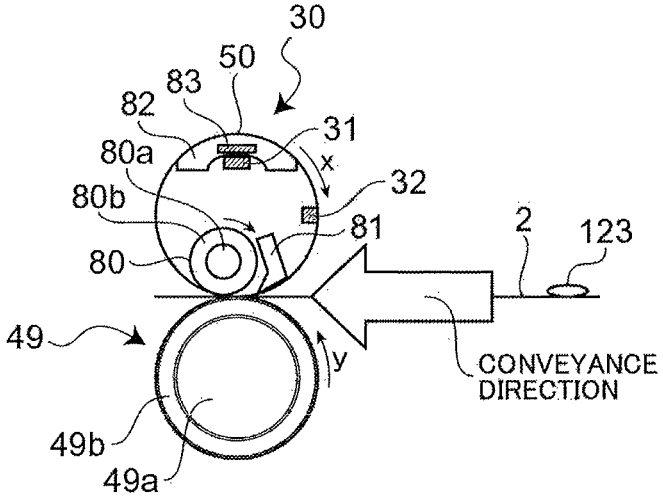
FIG. 6 is a schematic diagram showing an essential structure of a fixing unit according to the first embodiment of the invention.

Next, the fixing unit 30 according to this embodiment is described. FIG. 6 is a side cross-sectional diagram for describing an essential portion of the fixing unit 30, and is a diagram showing a state that the paper 2 attaching the toner 123 is conveyed in an arrow direction in FIG. 6 and passes through a nipping portion formed between the fixing belt 50 serving as the fixing member and the pressure roller 49 serving as the pressure member.

The fixing unit 30 is arranged in a state that the fixing belt 50 and the pressure roller 49 are in pressurized contact with each other. The fixing belt 50 inside includes the fixing roller 80, the pressure pad 81, the heat dissipation member 82 storing the planer heater 83, the temperature detection element 31 detecting temperature of the back surface of the planer heater 83, and the temperature detection element 32 detecting the inner side temperature of the fixing belt 50.

The fixing belt 50 is an endless belt member tensioned with the fixing roller 80, the pressure pad 81, and the heat dissipation member 82, and is structured so as to be driven in arrow x direction in FIG. 6 as driven by rotation of the fixing roller 80. The fixing belt 50 drives as heated with the planer heater 83 via the heat dissipation member 82 contacting thereto. Such a fixing belt 50 can be formed of, e.g., a silicone rubber covering an outer periphery of a polyimide base material, an outer periphery of which is further covered with a PFA (tetrafluoroethylene-perfluoro (alkoxy vinyl ether)-copolymer) tube.

The pressure roller 49 includes a core metal portion 49*a* and an elastic layer 49*b*. The pressure roller 49 according to this embodiment can be structured of an insulation sponge material such as a silicone sponge for the elastic layer 49*b*, whose outer periphery is covered with a PFA tube and formed in a roller shape. It is to be noted that no heater is provided inside the core metal portion 49*a* of the pressure roller 49, and that the pressure roller 49 can be made in a hollow shape in which each end of the core metal portion 49*a* is shield or open. The pressure roller 49 is in pressurized contact with the fixing belt 50, so that a pressed deformed region is formed as a nipping portion. The pressure roller 49 is driven by drive of the fixing belt 50, and can rotate in arrow y direction in FIG. 6 as in a state forming the nipping portion.

The fixing roller 80 includes a core metal portion 80*a* and an elastic layer 80*b*. The fixing roller 80 according to this embodiment can be structured of a silicone sponge for the elastic layer 80*b* in a roller shape. Fixing gears, not shown, are provided at an end of the core metal portion 80*a*, and can drive the fixing belt 50 in arrow x direction in FIG. 6 by rotating in arrow y direction in FIG. 6 according to transmitted drive force based on control of the fixing member rotation control unit 113.

The pressure pad 81 is provided for tensioning and guiding the fixing belt 50. The pressure pad 81 is a bar member having a length in a longitudinal direction, which is equal to the length of the fixing belt 50 in a short direction. Each end of the pressure pad 81 is supported by a side frame, not shown, of the fixing unit 30.

The heat dissipation member 82 is a metal member transmitting heat generated at the planer heater 83 and serving for tensioning and guiding the fixing belt 50.

Figure 7:
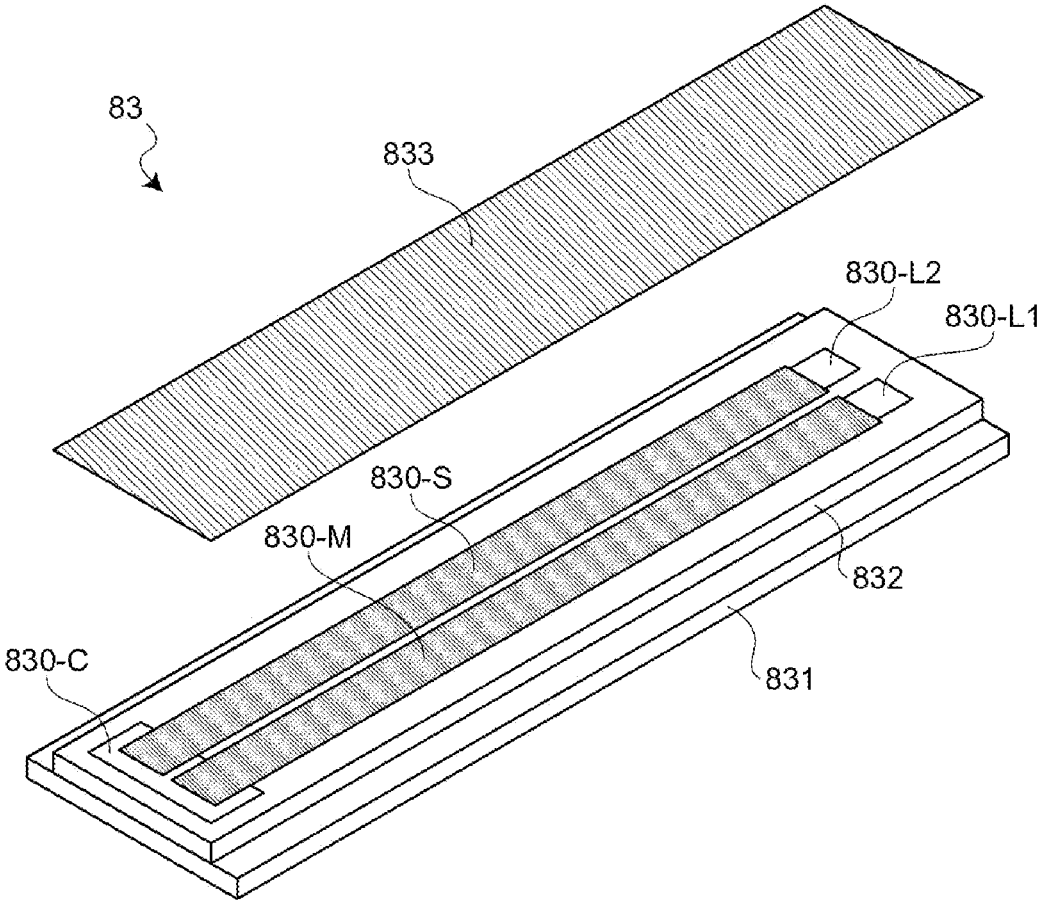
FIG. 7 is a perspective diagram showing an example of a planar heater according to the first embodiment of the invention.

The planer heater 83 has a structure that resistors are provided on a planer base and a heat generator generating heat by flowing currents through the resistors. The planer heater 83 according to this embodiment, as shown in FIG. 7, is formed with a glass layer 832 ensuring electrical insulation arranged on a metal plate 831 as a base material represented by such as stainless steel and aluminum, and with a resistor 830-M and a resistor 830-S arranged thereon by a coating method. There is a difference between the resistor 830-M and the resistor 830-S, and the output when turned on is in a relationship of "output of the resistor 830-M" is equal to or greater than "output of the resistor 830-S." Conductivity to the resistors is ensured by coating electrodes 830-L1, 830-L2, 830-C made of silver or gold for flowing current through the resistor 830-M and the resistor 830-S, and those electrodes are covered by a glass 833 or the like to form the planer heater 83 according to the embodiment.

Figure 8:
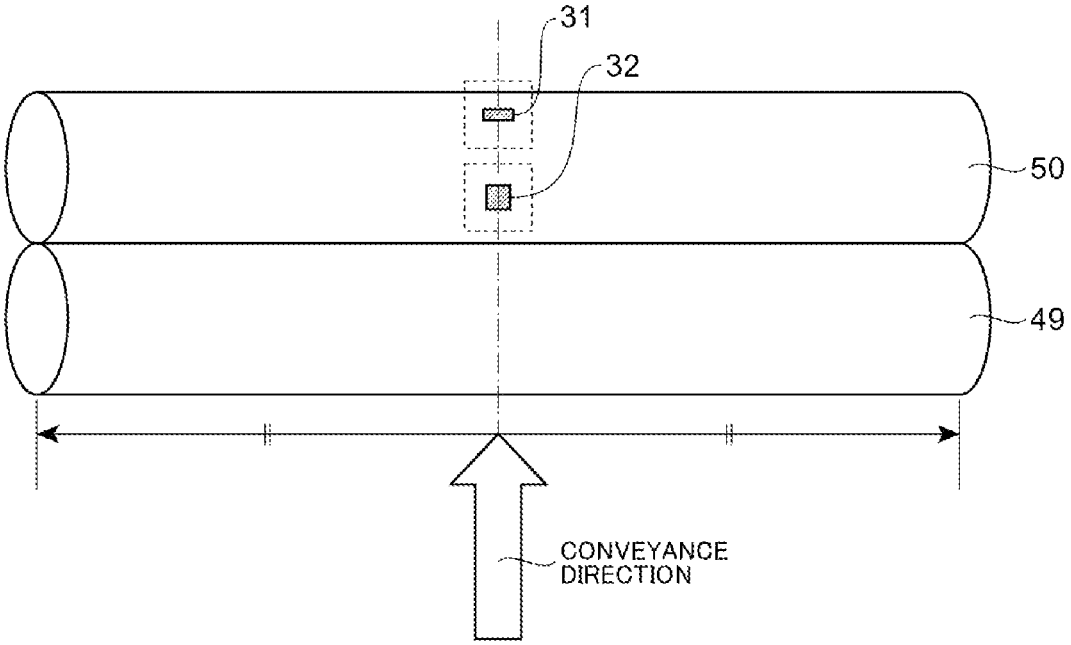
FIG. 8 is an illustration showing a layout of thermal detection elements according to the first embodiment of the invention.

The temperature detection element 31 and the temperature detection element 32 are disposed at a center in a longitudinal direction inside the fixing belt 50 as shown in FIG. 8. As described above, temperature detection element 31 and the temperature detection element 32 can be structured of, e.g., a thermistor, and outputs of temperature detection element 31 and the temperature detection element 32 are detected as the temperature of the back side of the planer heater 83 and the temperature of the inner side of the fixing belt 50 at the temperature detection units 115, 116, respectively, and are outputted to the fixing temperature control unit 118 as temperature information. In FIG. 8, the mounted positions of the respective temperature detection elements 31 and 32 are shown with surrounding broken lines, so that the respective temperature detection elements 31 and 32 are recognized as mounted inside the fixing belt 50.

Figure 9A:
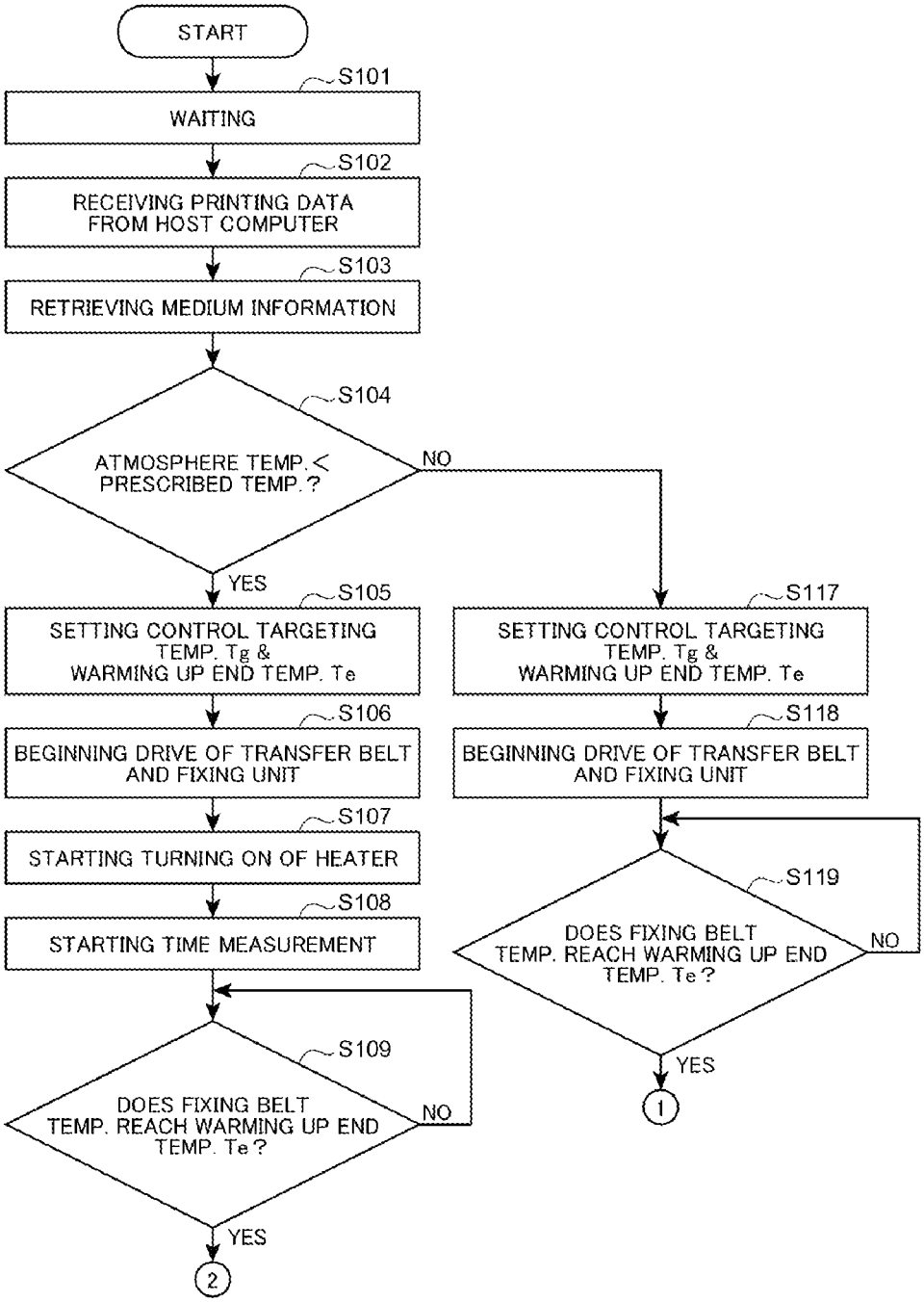
FIGS. 9A, 9B are a flowchart for operation up to an end of image formation done by an electrophotographic process unit according to the first embodiment of the invention.
Figure 9B:
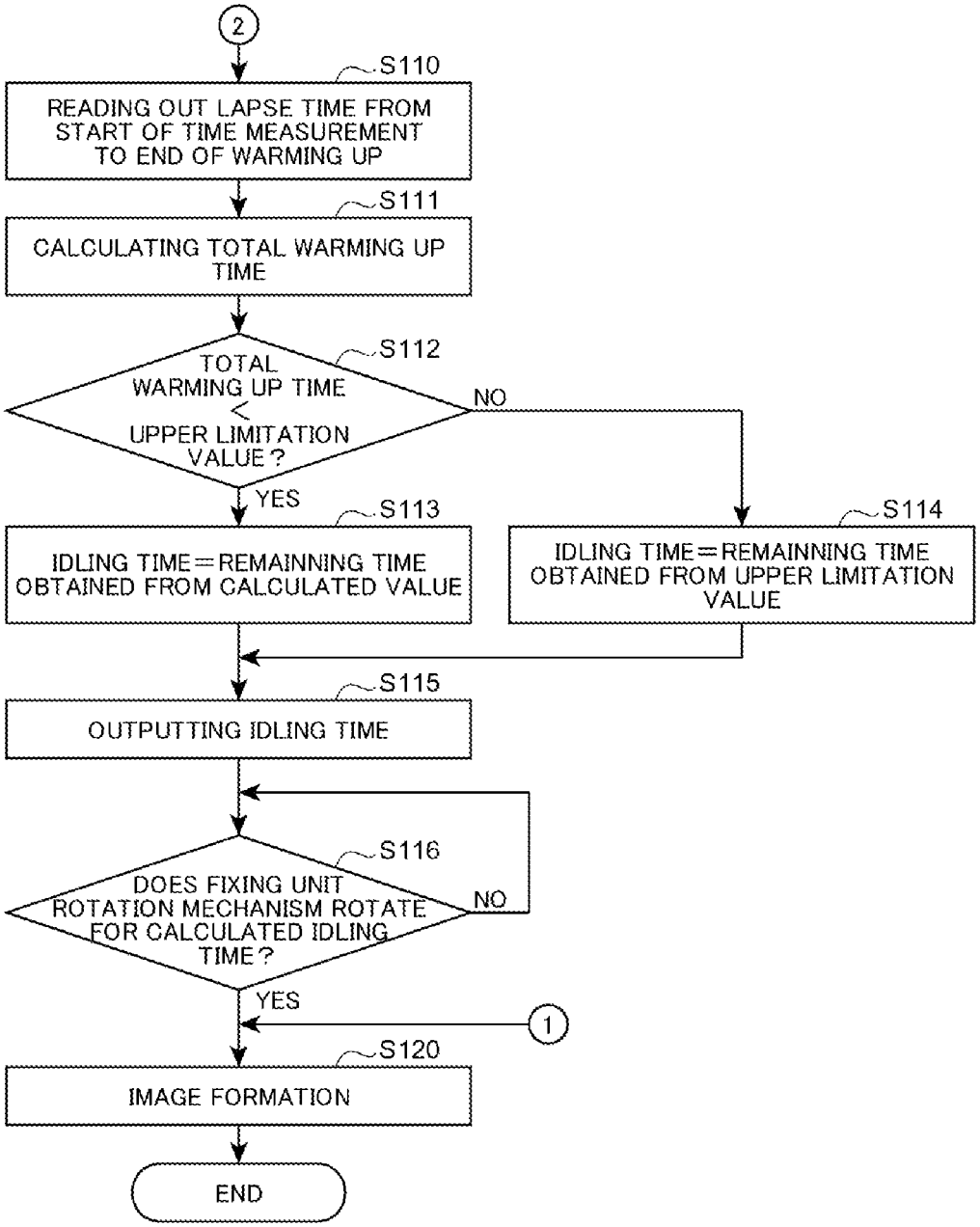
Figure 10:
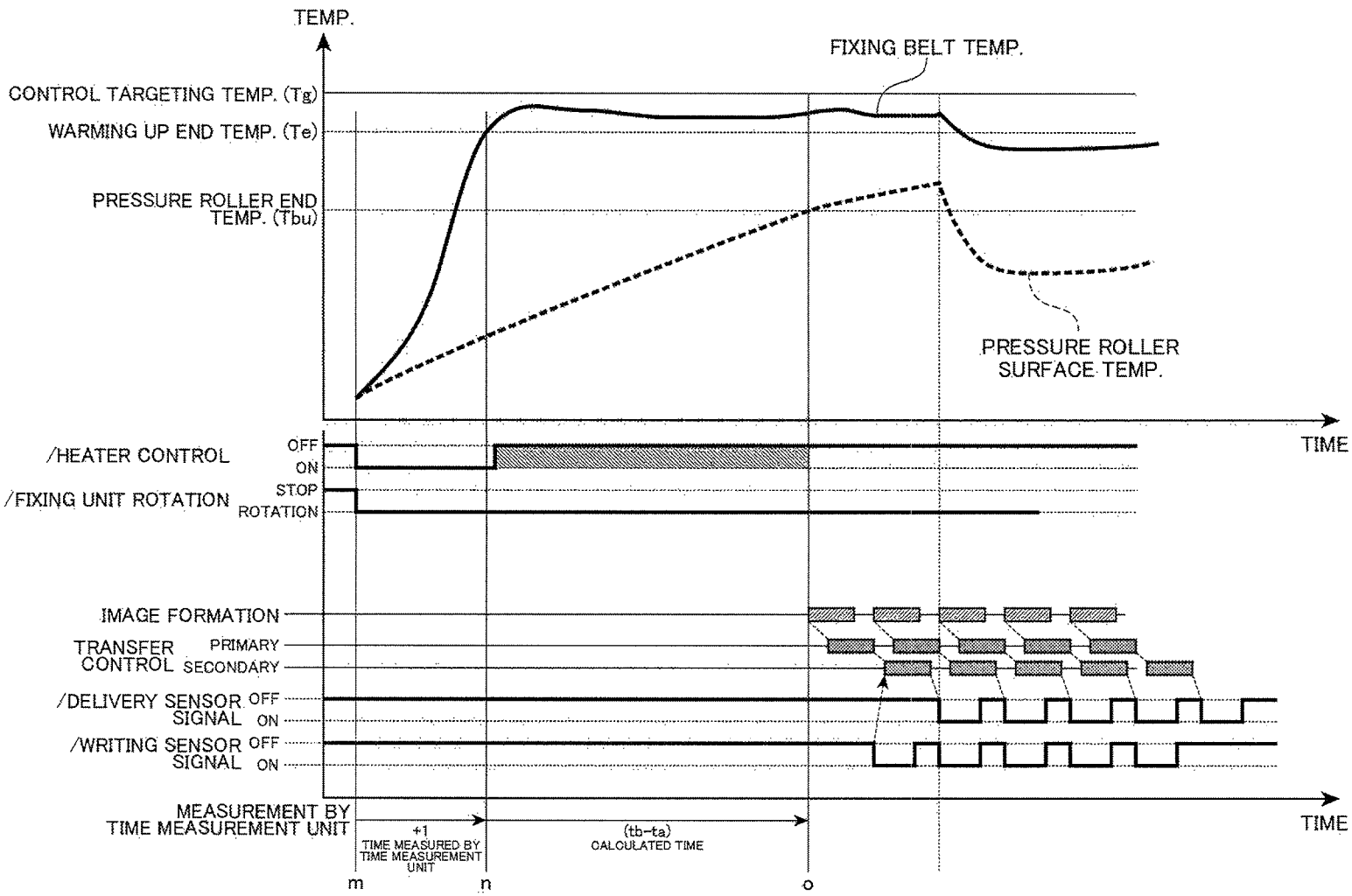
FIG. 10 is a timing chart for illustrating timings of image forming control, transfer control, signal output of a writing sensor and a delivery sensor, and temperature control of a fixing belt, according to the first embodiment of the invention.
Figure 11:
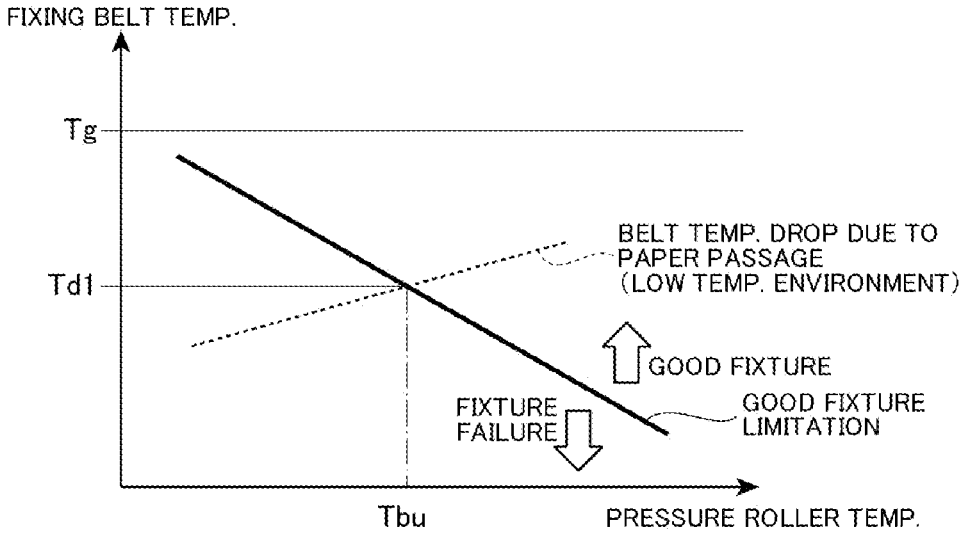
FIG. 11 is a schematic diagram for showing a general tendency of good fixing limitation range when a fixing belt and a pressure roller are used.
Figure 12:
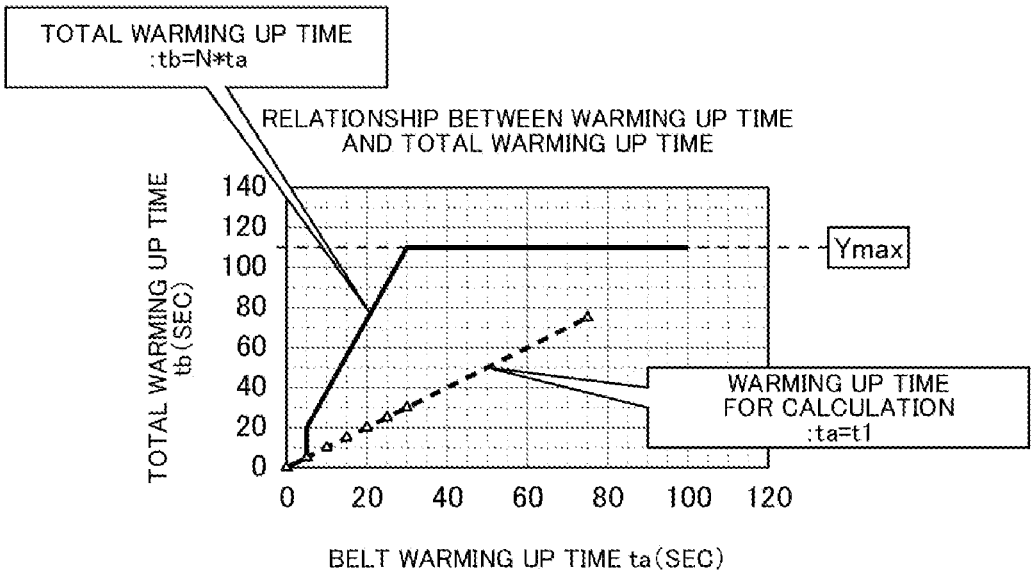
FIG. 12 is a diagram illustrating a calculation summary for calculating an idling time from warming up time according to the first embodiment of the invention.
Figure 13:
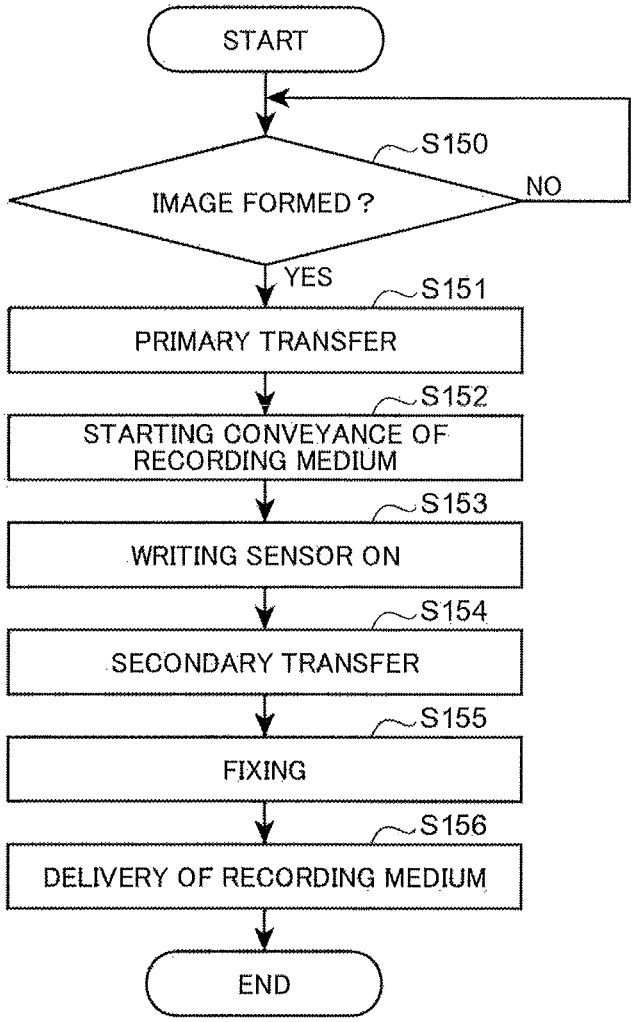
FIG. 13 is a flowchart for operation after a completion of the image formation done by the electrophotographic process unit according to the first embodiment of the invention.

Subsequently, operation of the printer 1 according to this embodiment is described in referring to FIGS. 9A, 9B, 10, 11, 12, and 13. FIGS. 9A, 9B are a flowchart for operation up to an end of image formation done by the electrophotographic process unit 10; FIG. 10 is a timing chart for illustrating timings of image forming control, transfer control, signal output of the writing sensor 62 and the delivery sensor 63, and temperature control of the fixing belt 50; FIG. 11 is a schematic diagram for showing a general tendency of good fixing limitation range when the fixing belt 50 and the pressure roller 49 are used; FIG. 12 is a diagram illustrating a calculation summary for calculating an idling time from warming up time; FIG. 13 is a flowchart for operation after a completion of the image formation done by the electrophotographic process unit 10.

When the control unit 106 waiting for reception of printing data at Step S101 in FIG. 9A receives the printing data from the host computer 151 via the interface unit 150 (Step S102), the control unit 106 reads out medium information managed at the medium information management unit 163 such as, e.g., medium size, medium thickness, medium type, medium weight (weight per unit) and renders the memory unit 107 store the information (Step S103). In this embodiment, the medium size of the recording medium used for printing is "A4" and "lateral feeding," and the setting of the medium weight is "plain paper (weight per unit 80 g/m$^2$)."

Next, the control unit 106 reads out the atmosphere temperature among the environmental data detected with the environmental value detection unit 500 and judges as to whether the atmosphere temperature is lower than the prescribed temperature. In this embodiment, the prescribed temperature is set to 16 degrees Celsius, and an example of a low temperature environment is described.

Where the atmosphere temperature is lower than the prescribed temperature (Yes at Step S104), the control unit 106 notifies this information to the temperature setting unit 117 of the fixing temperature control unit 118. The temperature setting unit 117 receiving the notice looks up the medium information stored by the control unit 106 in the memory unit 107, and sets the control target temperature Tg and the warming up end temperature Te (Step S105). In this embodiment, the temperature setting unit 117 sets that the control target temperature Tg is 165 degrees Celsius and the warming up end temperature Te is 160 degrees Celsius.

The control unit 106 at Step S106 looks up the medium information stored in the memory unit 107, and begins drive of the intermediate transfer belt 21 and the fixing unit 30.

The fixing temperature control unit 118 controls the power source unit 112 to turn on the planer heater 83, thereby starting warming up (Step S107).

The time measure unit 181 starts time measurement upon the beginning of warming up operation in use of the timer 108 at Step S108. In FIG. 10, the start timing of the time measurement done be the timer 108 is timing of "m."

The fixing temperature control unit 118 judges as to whether the inner side temperature of the fixing belt 50 reaches the warming up end temperature Te (Step S109). In FIG. 10, the judgment timing done by the fixing temperature control unit 118 is a timing of "n." At that time, when a surface temperature of the pressure roller 49 not formed with any temperature detection unit is considered, it would be a broken line shown in FIG. 10, and it turns out that the surface temperature of the pressure roller 49 does not reach the pressure roller end temperature Tbu as a necessary temperature sought from experiments. Accordingly, in order to make the surface temperature of the pressure roller 49 reach the pressure roller end temperature Tbu, idling operation of the fixing member rotation mechanism 173 must be extended further from the timing of "n" in FIG. 10.

Now, a general tendency of a good fixture limitation range when the fixing belt 50 and the pressure roller 49 are used is described in use of FIG. 11. Where the paper 2 getting use to a low temperature environment is made to pass through a nipping portion formed between the fixing belt 50 and the pressure roller 49, a belt temperature drop is shown as in FIG. 11, and an intersection point to a solid line showing the good fixture limitation range (boundary) occurs. In this embodiment, the surface temperature of the pressure roller 49 at the intersection point is set as the pressure roller end temperature Tbu. This intersection point can be sought by experiments, and in this embodiment, it is set to 125 degrees Celsius. In a region that the surface temperature of the pressure roller 49 is higher than the pressure roller end temperature Tbu, it means that fixing operation would be done in a good way. To the contrary, in a region that the surface temperature of the pressure roller 49 is lower than the pressure roller end temperature Tbu, it means that fixing operation would be done in a poor way and may cause fixing failures. The inner side temperature Transportation destination of the fixing belt 50 at the intersection point is set to 140 degrees Celsius.

To obtain a good fixing nature, the surface temperature of the pressure roller 49 is required to reach the pressure roller end temperature Tbu. In this embodiment, there is no means for detecting the surface temperature of the pressure roller 49, so that the control has to be done with idling time of the fixing member rotation mechanism 173. How much time required for the idling time can be calculated by the graph shown in FIG. 12.

In FIG. 12, belt warming up time of the fixing belt 50 is defined as t1; total warming up time from timing "m" to timing "n" in FIG. 10 sought by calculation is defined as tb; warming up time for calculation is defined as ta. Herein, the warming up time for calculation ta is given as ta=t1, and the total warming up time tb is given as tb=N*ta. The coefficient N is set as N=3.75, providing N=1 if the warming up time t1 is equal to or less than 5.

In this embodiment, the upper limitation value Ymax is set so that the total warming up time tb does not exceed the upper limitation value. The value Ymax is a value considering necessary time for the surface temperature of the pressure roller 49 to reach the pressure roller end time Tbu. The value Ymax can be changed according to physical nature of the pressure roller 49, output of the planer heater 83, rotation speed of the fixing roller 80, and printing mode, and in this embodiment, the Ymax value is set to 110 seconds.

If tb≤Ymax, tb−ta is set to remaining idling time. To the contrary, if tb>Ymax, the remaining idling time is set so that the total warming up time including t1 and a section from "m" to "n" in FIG. 10 is shown as Ymax.

The value of the coefficient N(=3.75) is a value sought from actually measured data as to how much value is to be multiplied for the warming up time of the fixing belt 50, to calculate the time up to when the surface temperature of the pressure roller 49 reaches the pressure roller end temperature Tbu. If t1≤5, it can be predicted that the fixing belt 50 and the pressure roller 49 are adequately warmed up, so that the value of the coefficient N can be set to 1 in meaning that no idling is required for the fixing member rotation mechanism 173.

Returning to FIG. 9A again, if the inner side temperature of the fixing belt 50 reaches the warming up end temperature Te (Yes, at Step S109), the time measure unit 181 reads out the time lapsed until the end of warming up from the timer 108 (Step S110 in FIG. 9B).

The control unit 106 calculates the total warming up time tb from the value of time read out of the time measure unit 181 (Step S111).

The control unit 106 judges as to whether the calculated total warming up time tb is smaller than the value Ymax as the upper limitation value. If the total warming up time tb is smaller than the value Ymax (Yes, Step S112), the control unit 106 sets the remaining idling time of the fixing member rotation mechanism 173 from the calculated total warming up time tb (Step S113). To the contrary, the total warming up time tb is equal to or larger than the value Ymax (No, Step S112), the control unit 106 sets the remaining idling time of the fixing member rotation mechanism 173 so that the total warming up time becomes the value Ymax (Step S114).

At Step S115, the rotation time setting unit 180 drives the fixing member rotation control unit 113 so as to continue the rotation only by the idling time set with the control unit 106.

The control unit 106 then judges as to whether the fixing member rotation mechanism 173 such as, e.g., the fixing roller 80 driven by the fixing member rotation control unit 113 rotates for required idling time. If the fixing member rotation mechanism 173 rotates for the required idling time (Yes, Step S116), the control unit 106 notifies the image formation control unit 400 of this information, and the image formation control unit 400 thus receiving the notice controls the electrophotographic process unit 10 to form images (Step S120). To the contrary, where the fixing member rotation mechanism 173 does not rotate for the required idling time (No, Step S116), the fixing member rotation control unit 113 continues rotation of the fixing member rotation mechanism 173.

At Step S104, if the atmosphere temperature is equal to or higher than the prescribed temperature (No, Step S104), the control unit 106 notifies the temperature setting unit 117 of the fixing temperature control unit 118 of this information. The temperature setting unit 117 thus receiving the notice looks up the medium information stored by the control unit 106 in the memory unit 107, and sets the control target temperature Tg and the warming up end temperature Te (Step S117).

The control unit 106 looks up the medium information stored in the memory unit 107, and starts drive of the intermediate transfer belt 21 and the fixing unit 30 (step S118).

The fixing temperature control unit 118 judges as to whether the inner side temperature of the fixing belt 50 reaches the warming up end temperature Te. If the inner side temperature of the fixing belt 50 reaches the warming up end temperature Te (Yes, Step S119), the control unit 106 notifies the image formation control unit 400 of this information, and the image formation control unit 400 upon receiving the notice controls the electrophotographic process unit 10 to form images (Step S120). In FIG. 10, the timing of image forming start by the electrophotographic process unit 10 is timing of "o."

Next, operation after completion of image formation done by the electrophotographic process unit 10 is described in referring to FIG. 13.

The control unit 106 first judges as to whether the electrophotographic process unit 10 makes image formation. If it is judged that the electrophotographic process unit 10 forms images (Yes, Step S150), the control unit 106 notifies the transfer control unit 302 of this information. The transfer control unit 302 upon receiving the notice controls the high voltage power source 303 to apply the transfer voltage to the primary transfer rollers 22 to 26, thereby making primary transfer of the toner images formed by the electrophotographic process unit 10, to the intermediate transfer belt 21 (Step S151). In this embodiment, the transfer voltage applied to the primary transfer rollers 22 to 26 is, for example, around 3 kV. To the contrary, if it is judged that the electrophotographic process unit 10 does not form images (No, Step S150), the control unit 106 waits until the completion of image formation.

Next, at Step S152, the paper conveyance control unit 114 receives an input of the paper conveyance signal from the control unit 106, and outputs a drive signal to the motor drive control unit 119. The paper conveyance mechanism 174 starts conveyance of the paper 2 according to the drive signal outputted from the motor drive control unit 119.

When a front end of the paper 2 reaches the position of the writing sensor 62, the writing sensor 62 is turned on (Step S153). If the writing sensor 62 is turned on and the control unit 106 recognizes the position of the paper 2, the control unit 106 notifies the transfer control unit 302 of this information. The transfer control unit 302 upon receiving the notice controls the high voltage power source 303 to apply the transfer voltage to the secondary transfer rollers 47, 48, thereby transferring the toner images on the intermediate transfer belt 21 to the paper thus conveyed (step S154). In this embodiment, the transfer voltage applied to the secondary transfer rollers 47, 48 is, for example, around 1 kV.

The paper 2 onto which the toner images are transferred is further conveyed to the fixing unit 30, and is applied with heat and pressure at the fixing unit 30, thereby fixing the toner images onto the paper 2 (step S155).

Next, at Step S156, the control unit 106 controls the fixing member rotation control unit 113 as to deliver the paper 2 on which fixing is made, and the fixing member rotation control unit 113 drives the fixing member rotation mechanism 173 to deliver the paper 2. The control unit 106 at that time recognizes the delivery of the paper 2 because the paper 2 passes by the delivery sensor 63.

Subsequently, the paper 2 is continuously conveyed to the fixing unit 30. Paper conveyance speed at that time is, for example, 235 mm/s, and an interval between the rear end of the paper 2 and the front end of the paper 2 (so called paper interval) can be set to 70 mm. The planer heater 83 is controlled as that the inner side temperature of the fixing belt 50 at that time comes close to the control target temperature Tg.

As described above, according to the first embodiment, the idling time of the fixing unit 30 can be calculated from information of the detected atmosphere temperature and the warming up time of the fixing belt 50, so that the image forming apparatus can suppress fixing failure at the printing initial stage from occurring even where omitting detected result of the surface temperature of the pressure roller 49.

Second Embodiment

The structure of the printer according to the second embodiment is substantially the same as that of the printer 1 according to the first embodiment. Accordingly, in the following description, members and operation the same as those of the first embodiment are assigned with the same reference numbers but omitted from detailed description for the sake of simplicity.

Figure 14:
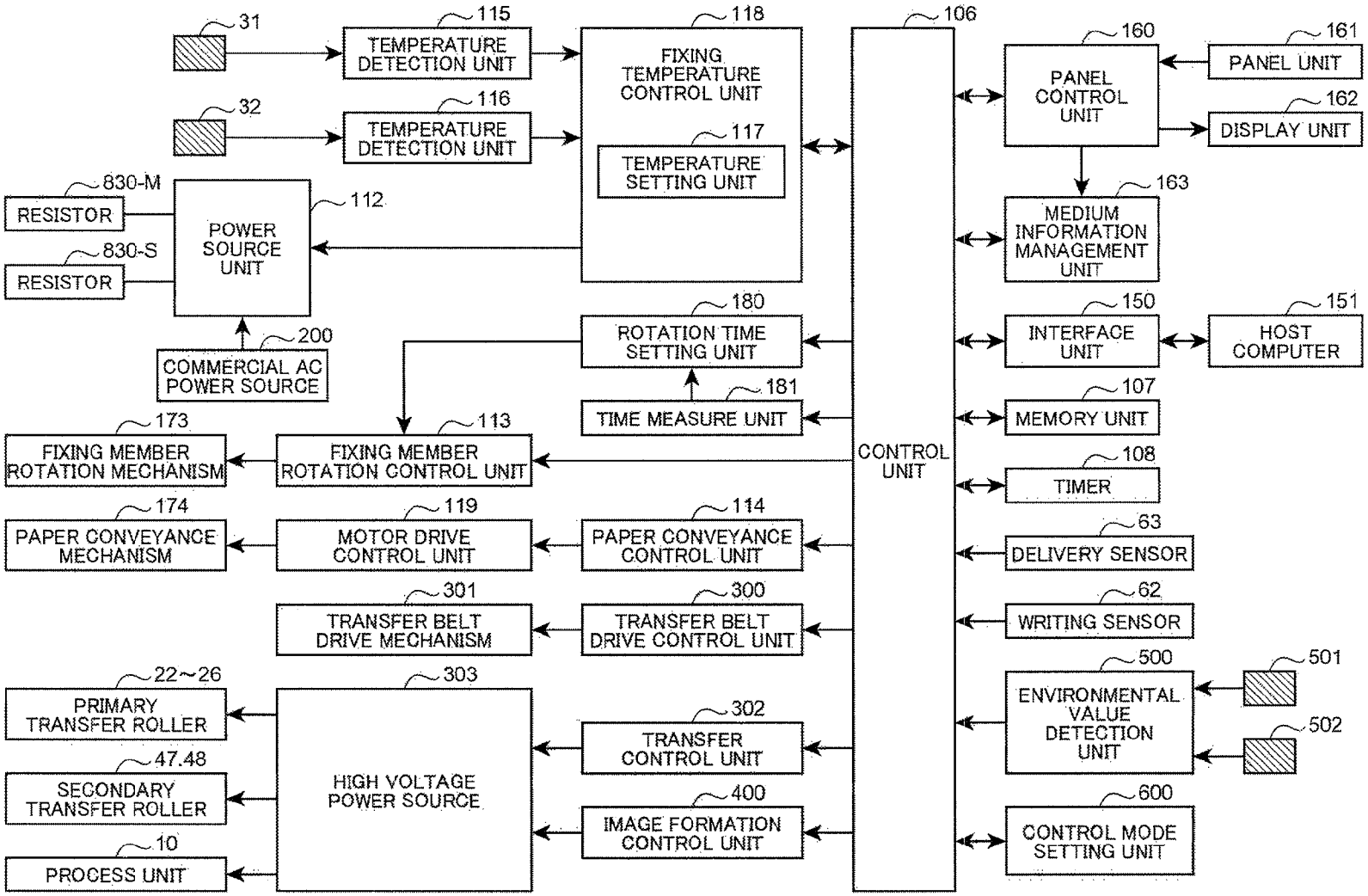
FIG. 14 is a block diagram showing a functional structure of the printer according to a second embodiment of the invention.

FIG. 14 is a block diagram describing a functional structure of a printer according to the second embodiment. As shown in FIG. 14, in this embodiment, a control mode setting unit 600 is provided in addition to the functional structure of the printer 1 according to the first embodiment.

The control mode setting unit 600 stores the control mode set with the control unit 106 based on information obtained through user's setting from manipulation of the panel unit 161 and on the environmental data read by the control unit 106 out of the environmental value detection unit 500. The control unit 106 can read out the control mode stored by the control mode setting unit 600.

Figure 15:
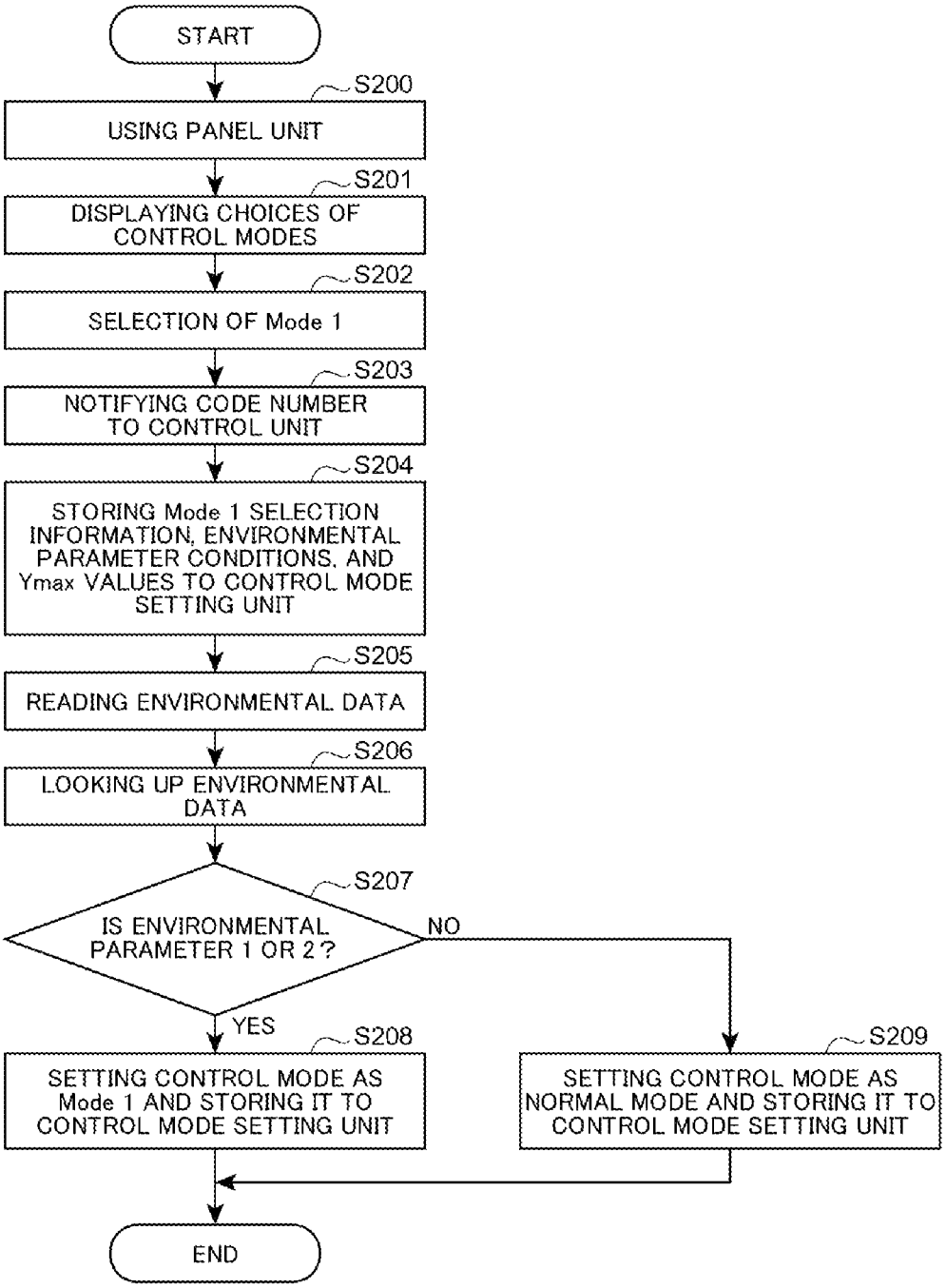
FIG. 15 is a flowchart for setting of a control mode according to the second embodiment of the invention.
Figure 18A:
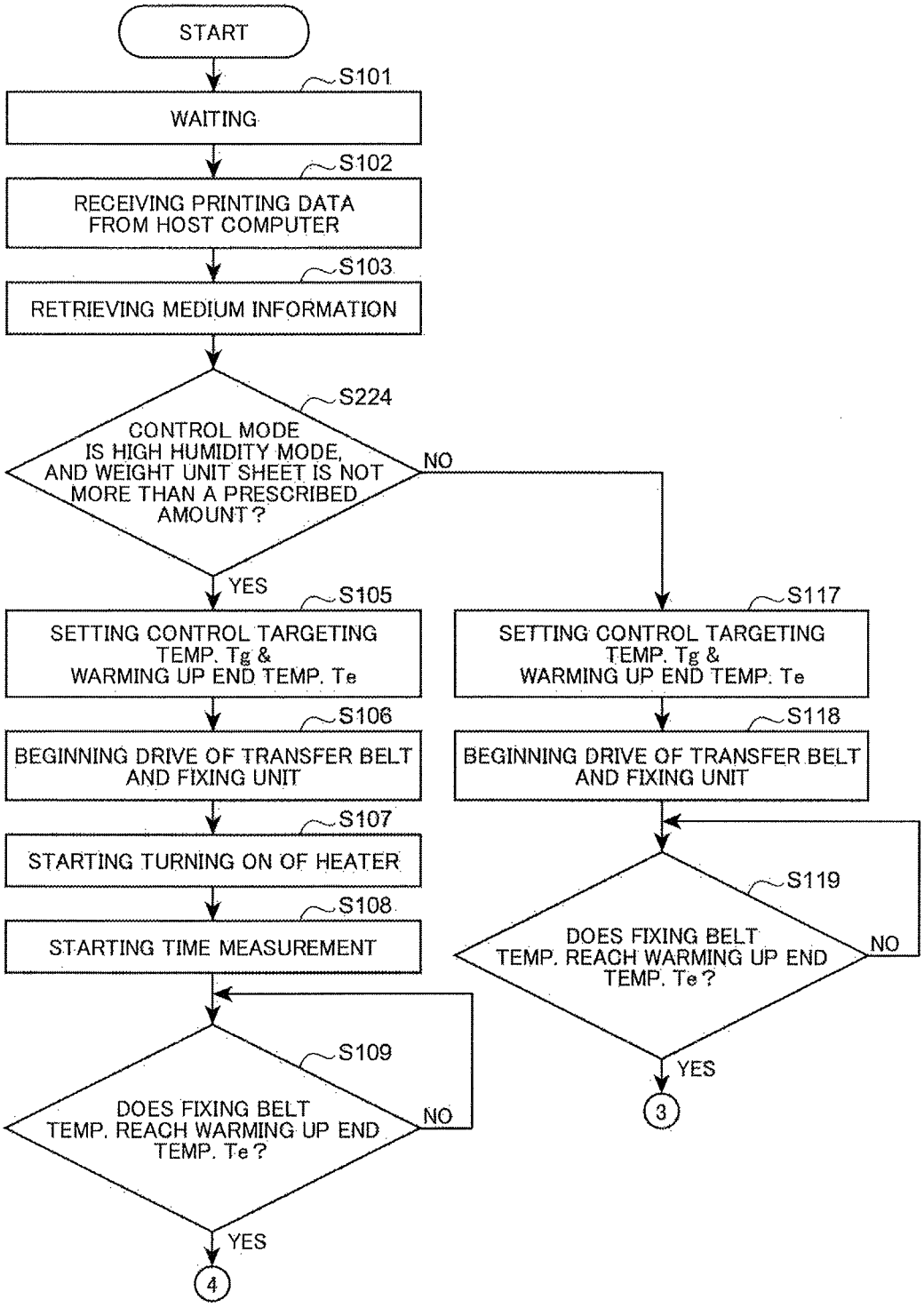
FIGS. 18A, 18B are a flowchart for operation up to an end of image formation done by an electrophotographic process unit according to the second embodiment of the invention.
Figure 18B:
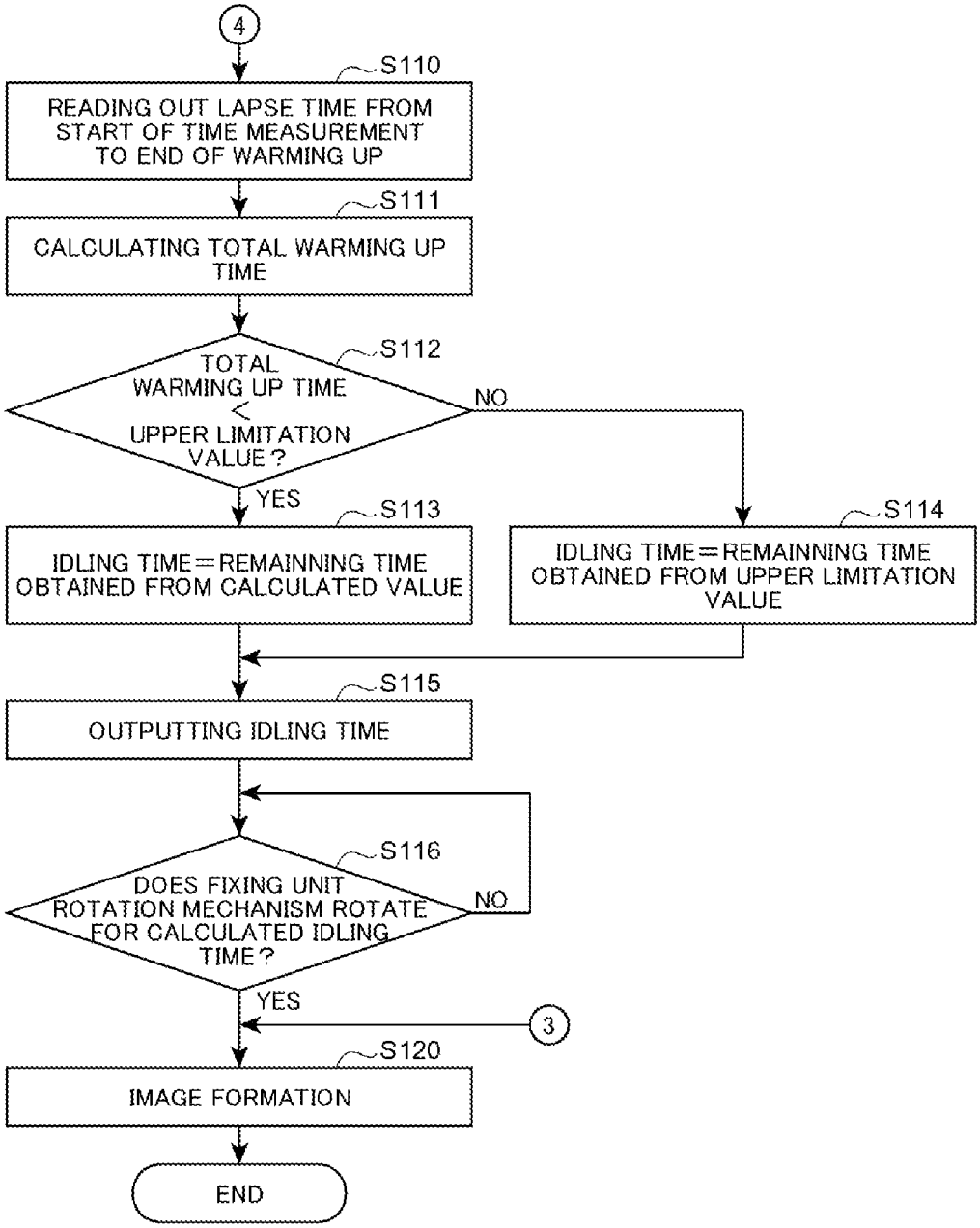
Figure 19:
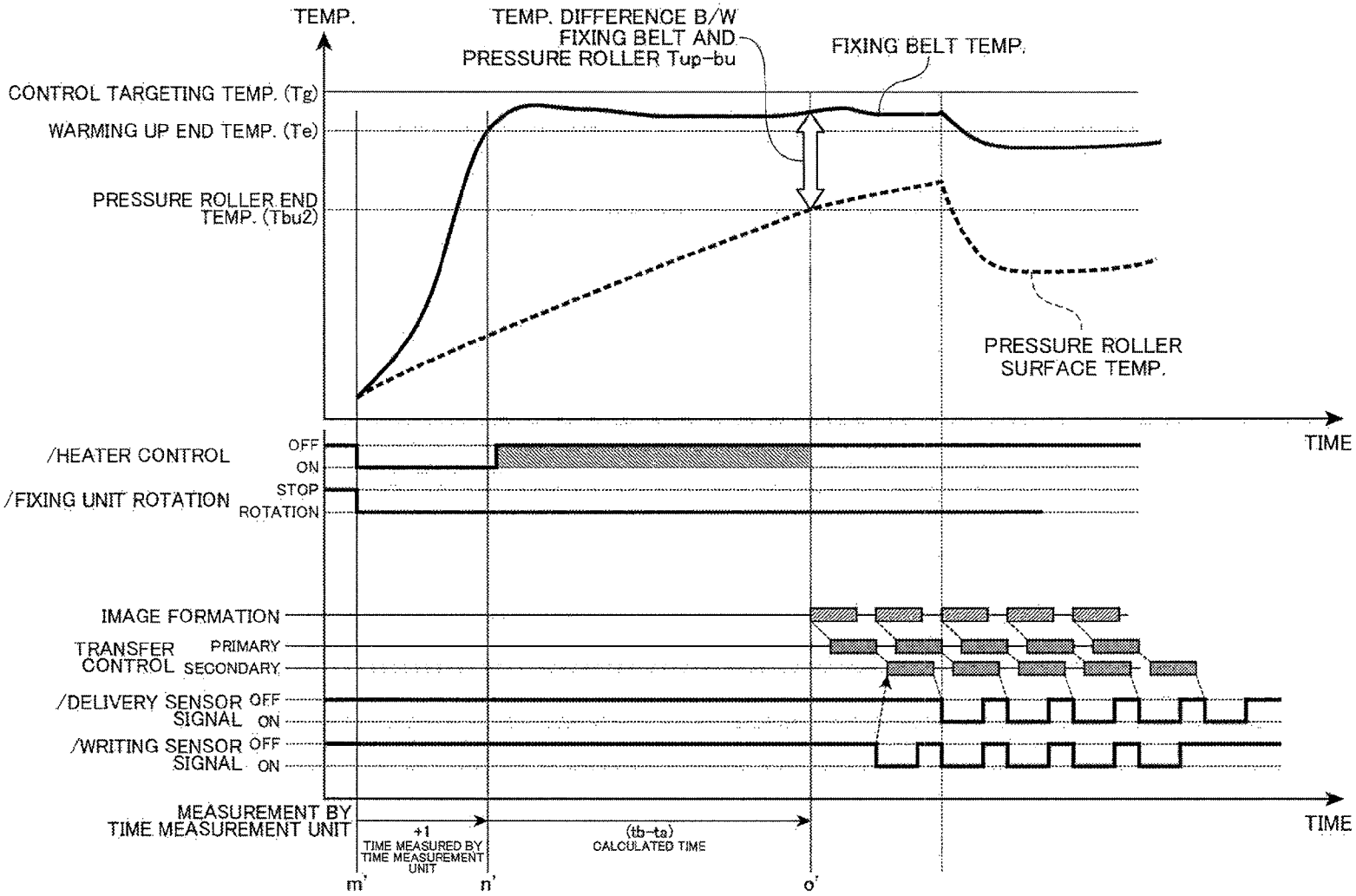
FIG. 19 is a timing chart for illustrating timings of image forming control, transfer control, signal output of a writing sensor and a delivery sensor, and temperature control of a fixing belt, according to the second embodiment of the invention.
Figure 20:
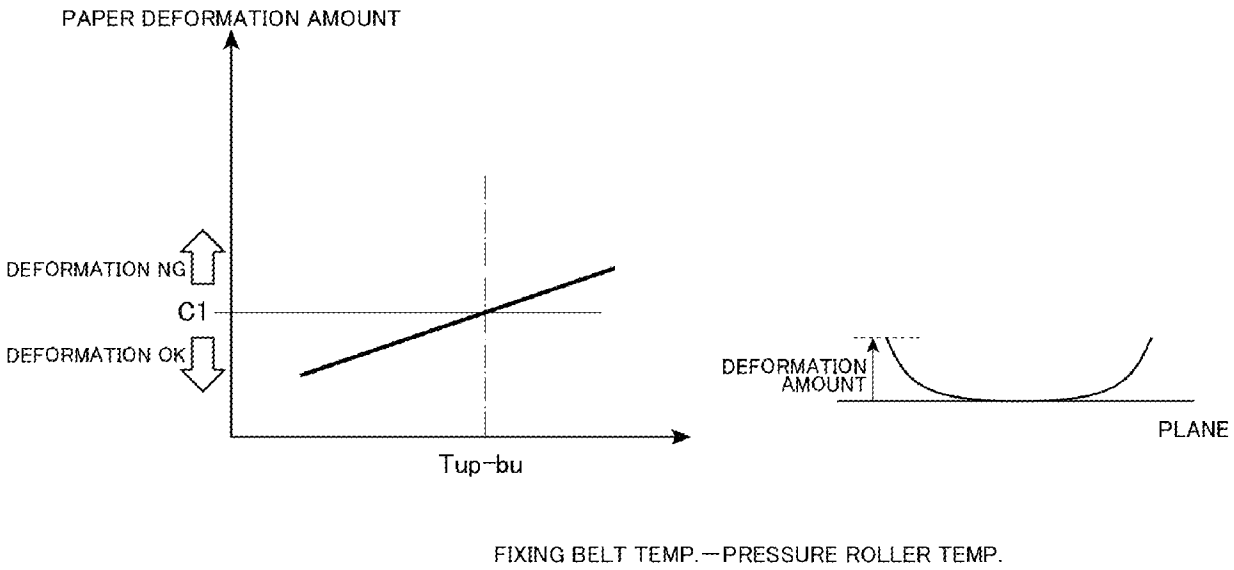
FIG. 20 is a schematic diagram for showing a general tendency of paper deformation (curling) when a fixing belt and a pressure roller are used.
Figure 21:
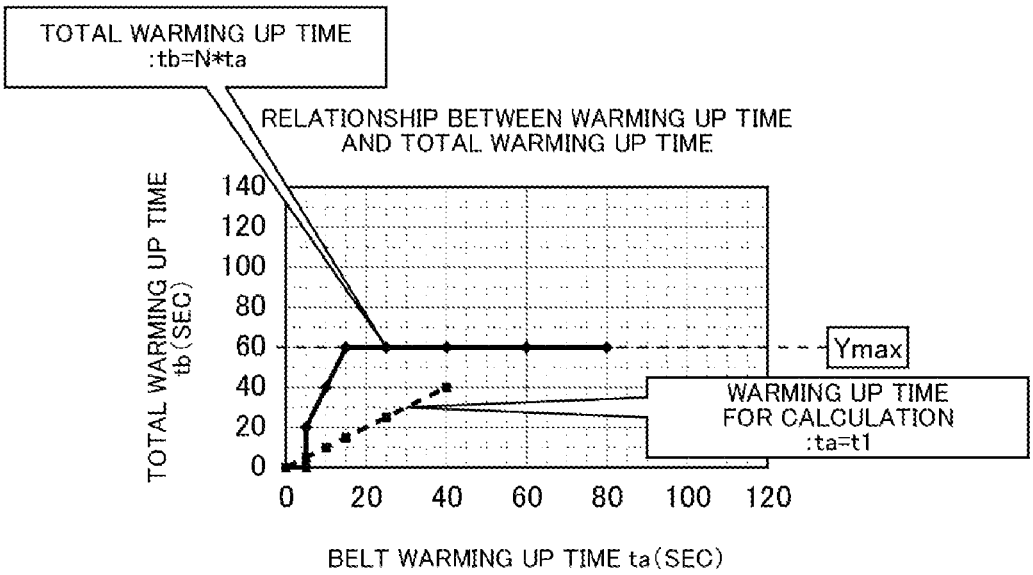
FIG. 21 is a diagram illustrating a calculation summary for calculating an idling time from warming up time according to the second embodiment of the invention.

Subsequently, operation of the printer according to this embodiment is described in referring to FIGS. 15, 16, 17, 18A, 18B, 19, 20, and 21. FIG. 15 is a flowchart for setting of a control mode; FIG. 16 is a table for an example of the control mode; FIG. 17 is a table for temperature versus humidity used for deciding environmental parameters; FIGS. 18A, 18B are a flowchart for operation up to an end of image formation done by the electrophotographic process unit 10; FIG. 19 is a timing chart for illustrating timings of image forming control, transfer control, signal output of the writing sensor 62 and the delivery sensor 63, and temperature control of the fixing belt 50; FIG. 20 is a schematic diagram for showing a general tendency of paper deformation (curling) when a fixing belt and a pressure roller are used; and FIG. 21 is a diagram illustrating a calculation summary for calculating an idling time from warming up time.

At Step S200 in FIG. 15, a user manipulates keys of the panel unit 161 until when choices of the control modes are displayed on the display unit 162 of the display panel shown in FIG. 5 to select a desired control mode.

The control unit 106 displays choices of the control modes at the display unit 162 via the panel control unit 160 based on information of the panel unit 161 manipulated by the user as Step S201.

Then, the user manipulates the panel unit 161 and selects one control mode among several control modes as shown in FIG. 16. In this embodiment, the user selects "Mode 1" as the control mode as Step S202. In the table shown in FIG. 16, the control mode means the control mode of the printer selected by the user, and in this embodiment, three types of the control modes, "OFF" as a default, "Mode 1," and "Mode 2," are provided. The term "code number" is information used for exchanging information between the panel control unit 160 and the control unit 106. The code number is used for making the control unit 160 and the control unit 106 mutually recognize the control mode, and values independent to each other may be satisfied. In this embodiment, the number "0" is assigned to the code number of the mode "OFF"; the number "1" is assigned to the code number of the mode "Mode 1"; the number "2" is assigned to the code number of the mode "Mode 2." Environmental parameter conditions are environmental parameters set corresponding to the atmosphere temperature (range) and the atmosphere humidity (range) in the temperature and humidity table shown in FIG. 17. For example, where the control mode is "Mode 1," the value of the environmental parameter condition is set to "1 through 2," and it means that the atmosphere temperature and the atmosphere humidity corresponding to the environmental parameter condition are necessary as operation condition of the control mode "Mode 1." Where the control mode is "Mode 2," the value of the environmental parameter condition is set to "ANY," and it means that the atmosphere temperature and the atmosphere humidity are not necessary as operation condition of the control mode "Mode 2." The value Ymax is an upper limitation value of the total warming up time described in the first embodiment, and for example, where the control mode is "Mode 1," time 60 seconds is set, and where the control is "Mode 2," time 90 seconds is set. It is to be noted that the values Ymax respectively set at the control modes of "Mode 1" and "Mode 2" are values sought experimentally. If the control mode is "OFF," the value Ymax is not set.

Returning to FIG. 15, at Step S203, the panel control unit 160 notifies the control unit 106 of the code number of the control mode selected by the user via the panel unit 161.

The control unit 106 renders the control mode setting unit 600 store information that "Mode 1" is selected as the control mode, the environmental parameter condition, and the value of Ymax, from the notified code number (Step S204).

The control unit 106 reads out the environmental data (the atmosphere temperature and the atmosphere humidity) detected with the environmental value detection unit 500 (Step S205), and looks up the environmental parameter from the temperature and humidity table shown in FIG. 17 (Step S206).

Subsequently, the control unit 106 judges as to whether the result looked up at Step S206 is "1" or "2" as the environmental parameter condition stored in the control mode setting unit 600 at Step S204. If the looked-up result is "1" or "2" (Yes, Step S207), the control unit 106 defines the control mode as "Mode 1" and renders the control mode setting unit 600 store the control mode (Step S208). To the contrary, if the looked up result is not either "1" or "2" (No, Step S207), the control unit 106 defines the control mode as "Normal Mode" and renders the control mode setting unit 600 store the control mode (Step S209). It is to be noted that the environmental parameter "1" or "2" is a condition for high humidity, so that the control mode "Mode 1" can also be said as high humidity mode.

Operation up to the completion of image formation at the electrophotographic process unit 10 according to the second embodiment is described. The same operation or steps as those described in FIG. 9 according to the first embodiment may be omitted upon providing the same reference numbers for the sake of simplicity.

The control unit 106 waiting for reception of printing data at Step S101 in FIG. 18A receives the printing data from the host computer 151 via the interface unit 150 (Step S102), the control unit 106 reads out medium information managed at the medium information management unit 163 such as, e.g., medium size, medium thickness, medium type, medium weight (weight per unit) and renders the memory unit 107 store the information (Step S103). In this embodiment, the medium size of the recording medium used for printing is "A4" and "lateral feeding," and the setting of the medium weight is "plain paper (weight per unit 80 g/m$^2$)."

Next, the control unit 106 makes judgments of the control mode and the medium weight setting. The control unit 106 reads out the control mode described in FIG. 15 from the control mode setting unit 600, and judges as to whether the control mode is the high humidity mode. In this embodiment, the high humidity mode indicates that the control mode is either "Mode 1" or "Mode 2." The mode "Mode 1" is the high humidity mode, because of having a condition meeting with the high humidity condition (environmental parameter "1" or "2"), and the mode "Mode 2" is deemed as a high humidity mode because the mode "Mode 2" is a control mode existing on an extension line of the control mode "Mode 1." The mode "Normal Mode" indicates that the control mode is "OFF." The control unit 106 judges as to whether the medium weight setting (weight per unit) is equal to or less than the prescribed amount.

Where the control mode is the high humidity mode and where the medium weight setting (weight per unit) is equal to or less than the prescribed amount (Yes, Step S224), the control, unit 106 notifies the temperature setting unit 117 in the fixing temperature control unit 118 of this information. The temperature setting unit 117 upon receiving the notice looks up the medium information that the control unit 106 renders the memory unit 107 store, and sets the control target temperature Tg and the warming up end temperature Te (Step S105). In this embodiment, the temperature setting unit 117 sets the control target temperature Tg to 165 degrees Celsius and the warming up end temperature Te to 160 degrees Celsius.

The control unit 106 looks up the medium information stored in the memory unit 107 and starts drive of the intermediate transfer belt 21 and the fixing unit 30 (Step S106).

The fixing temperature control unit 118 controls the power source unit 112 to turn the planer heater 83 on, thereby starting warming up operation (Step S107).

The time measure unit 181 starts time measurement in being triggered by the beginning of the warming up operation in use of the timer 108 at Step S108. The start timing of the time measurement by the timer 108 is the timing of "m'" in FIG. 19.

The fixing temperature control unit 118 judges as to whether the inner side temperature of the fixing belt 50 reaches the warming up end temperature (Step S109). The judgment timing done by the fixing temperature control unit 118 is the timing of "n'" in FIG. 19. At that time, when a surface temperature of the pressure roller 49 not formed with any temperature detection unit is considered, it would be a broken line shown in FIG. 19, and it turns out that the surface temperature of the pressure roller 49 does not reach the pressure roller end temperature Tbu2 as a necessary temperature sought from experiments. Accordingly, in order to make the surface temperature of the pressure roller 49 reach the pressure roller end temperature Tbu2, idling operation of the fixing member rotation mechanism 173 must be extended further from the timing of "n'" in FIG. 19.

Now, a general tendency of paper deformation (curling) when the fixing belt 50 and the pressure roller 49 are used is described in use of FIG. 20. Paper deformation (curling) is a phenomenon that paper is contracted due to changes of moisture contained in the paper as to pull paper ends toward a center and to make the paper curved. The paper deformation is affected by environmental changes represented by surrounding temperature and humidity at which the paper is placed, and particularly, is largely affected by humidity changes when using a thin paper.

Because it is thought that such paper deformation can be suppressed as much as possible if moisture absorbed in the paper is discharged uniformly from front and back sides of the paper, it is considered to be effective to reduce the temperature difference between the fixing belt 50 and the pressure roller 49 as much as possible. From this thinking way, taking the abscissa as temperature difference between the temperatures of the fixing belt 50 and the pressure roller 49 and the ordinate as paper change amount, makes a graph as shown in FIG. 20. Where the change amount permissible as a specification is set to C1, the temperature difference between the fixing belt 50 and the pressure roller 49 as a threshold value of the paper deformation is "Tup−bu" shown in FIG. 19. The change amount at that time indicates a distance between a plane and a paper end where the paper is placed on the plane.

In a meantime, a value of the temperature difference Tup−bu between the fixing belt 50 and the pressure roller 49 is changeable, and it is not handled easily. Because there is a tendency that the control target temperature Tg−the pressure roller end temperature Tbu2≅the temperature difference Tup−bu between the fixing belt 50 and the pressure roller 49 (Tg−≅Tbu2≅Tup−bu), if the surface temperature of the pressure roller 49 reaches Tbu2, the temperature difference between the fixing belt 50 and the pressure roller 49 is deemed as smaller than the temperature difference Tup−bu between the fixing belt 50 and the pressure roller 49 serving as the threshold value of the paper deformation.

To obtain good anti-paper deformation property, it is considered that the surface temperature of the pressure roller 49 must reach Tbu2. In this embodiment, because no detecting means for detecting the surface temperature of the pressure roller 49 is provided, the control has to be done by idling time of the fixing member rotation mechanism 173. How much time required for the idling time can be calculated by the graph shown in FIG. 21.

In FIG. 21, belt warming up time of the fixing belt 50 is defined as t1; total warming up time from timing "m" to timing "n" in FIG. 19 sought by calculation is defined as tb; warming up time for calculation is defined as ta. Herein, the warming up time for calculation ta is given as ta=t1, and the total warming up time tb is given as tb=N*ta. The coefficient N is set as N=3.75, providing N=1 if the warming up time t1 is equal to or less than 5.

In this embodiment, the upper limitation value Ymax is set so that the total warming up time tb does not exceed the upper limitation value. The value Ymax is a value considering necessary time for the surface temperature of the pressure roller 49 to reach the pressure roller end time Tbu2. The value Ymax can be changed according to physical nature of the pressure roller 49, output of the planer heater 83, rotation speed of the fixing roller 80, and printing mode, and in this embodiment, the Ymax value is set to 60 because the control mode is set to "Mode 1."

If tb≤Ymax, tb−ta is set to remaining idling time. To the contrary, if tb>Ymax, the remaining idling time is set so that the total warming up time including t1 and a section from "m" to "n" in FIG. 19 is shown as Ymax.

The value of the coefficient N(=3.75) is a value sought from actually measured data as to how much value is to be multiplied for the warming up time of the fixing belt 50, to calculate the time up to when the surface temperature of the pressure roller 49 reaches the pressure roller end temperature Tbu2. If t1≤5, it can be predicted that the fixing belt 50 and the pressure roller 49 are adequately warmed up, so that the value of the coefficient N can be set to 1 in meaning that no idling is required for the fixing member rotation mechanism 173.

Returning to FIG. 18A again, if the inner side temperature of the fixing belt 50 reaches the warming up end temperature Te (Yes, at Step S109), the time measure unit 181 reads out the time lapsed until the end of warming up from the timer 108 (Step S110 in FIG. 18B).

The control unit 106 calculates the total warming up time tb from the value of time read out of the time measure unit 181 (Step S111).

The control unit 106 judges as to whether the calculated total warming up time tb is smaller than the value Ymax as the upper limitation value. If the total warming up time tb is smaller than the value Ymax (Yes, Step S112), the control unit 106 sets the remaining idling time of the fixing member rotation mechanism 173 from the calculated total warming up time tb (Step S113). To the contrary, the total warming up time tb is equal to or larger than the value Ymax (No, Step S112), the control unit 106 sets the remaining idling time of the fixing member rotation mechanism 173 so that the total warming up time becomes the value Ymax (Step S114).

At Step S115, the rotation time setting unit 180 drives the fixing member rotation control unit 113 so as to continue the rotation only by the idling time set with the control unit 106.

The control unit 106 then judges as to whether the fixing member rotation mechanism 173 such as, e.g., the fixing roller 80 driven by the fixing member rotation control unit 113 rotates for required idling time. If the fixing member rotation mechanism 173 rotates for the required idling time (Yes, Step S116), the control unit 106 notifies the image formation control unit 400 of this information, and the image formation control unit 400 thus receiving the notice controls the electrophotographic process unit 10 to form images (Step S120). To the contrary, where the fixing member rotation mechanism 173 does not rotate for the required idling time (No, Step S116), the fixing member rotation control unit 113 continues rotation of the fixing member rotation mechanism 173.

At Step S224, if the control mode is the high humidity mode and if the medium weight setting (weight per unit) is not equal to or less than the prescribed amount (No, Step S224), the control unit 106 notifies the temperature setting unit 117 in the fixing temperature control unit 118 of this information. The temperature setting unit 117 thus receiving the notice looks up the medium information stored by the control unit 106 in the memory unit 107, and sets the control target temperature Tg and the warming up end temperature Te (Step S117).

The control unit 106 looks up the medium information stored in the memory unit 107, and starts drive of the intermediate transfer belt 21 and the fixing unit 30 (step S118).

The fixing temperature control unit 118 judges as to whether the inner side temperature of the fixing belt 50 reaches the warming up end temperature Te. If the inner side temperature of the fixing belt 50 reaches the warming up end temperature Te (Yes, Step S119), the control unit 106 notifies the image formation control unit 400 of this information, and the image formation control unit 400 upon receiving the notice controls the electrophotographic process unit 10 to form images (Step S120). In FIG. 19, the timing of image forming start by the electrophotographic process unit 10 is timing of "o'."

A description for the operation after completion of the image formation done by the electrophotographic process unit 10 will be omitted, because the operation can be done in substantially the same way as described in use of FIG. 13 in the first embodiment.

As described above, according to the second embodiment, the image forming apparatus can suppress paper deformation from occurring even where not using any detected result of the surface temperature of the pressure roller 49, because the idling time of the fixing unit 30 is calculated from the information of the warming up time of the fixing belt 50 in conditioning the atmosphere temperature and humidity thus detected and the medium information.

In the above embodiments, the printer is explained as a suitable example of an image forming apparatus, but this invention is not limited to this and is applicable to such as, e.g., MFP (Multi-Functional Peripheral) apparatuses, facsimile machines, photocopiers, and other apparatuses conducting thermal fixing.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus for fixing, with heat and pressure, an image formed with a developer on a recording medium, comprising:

a fixing member rotatably supported for heating the developer;

a pressure member pressing the recording medium upon sandwiching the recording medium with the fixing member;

a temperature detection unit for detecting temperature of the fixing member;

a temperature control unit for controlling the temperature of the fixing member;

a rotation control unit for controlling rotation of the fixing member;

an environment value detection unit for detecting an atmosphere temperature;

a time measure unit for measuring time necessary for finish of warming up of the fixing member; and a rotation time setting unit for setting rotation time of the fixing member, wherein the rotation time setting unit changes the rotation time from a timing that the fixing member reaches a warming up temperature, based on a lapse time result provided from the time measure unit, where the atmosphere temperature is lower than a prescribed temperature.

2. The image forming apparatus according to claim 1, wherein the rotation time from the timing that the fixing member reaches the warming up temperature where the atmosphere temperature is lower than the prescribed temperature, is longer than rotation time from a timing that the fixing member reaches the warming up temperature where the atmosphere temperature is equal to or higher than the prescribed temperature.

3. The image forming apparatus according to claim 1, wherein the rotation time setting unit compares a prescribed upper limitation value with a value calculated based on the atmosphere temperature detected with the environment value detection unit and on the lapse time result provided from the time measure unit, and sets the rotation time of the fixing member based on a compared result thereof.

4. The image forming apparatus according to claim 1, further comprising a control mode setting unit for setting a control mode based on input information entered by an operator, and a medium information management unit for managing information on medium weight of the recording medium, wherein the environment value detection unit includes a humidity detection unit for detecting an atmosphere humidity, and wherein the rotation time setting unit changes the rotation time from a timing that the fixing member reaches the warming up temperature, based on a lapse time result provided from the time measure unit, where the medium weight of the recording medium managed with the medium information management unit is equal to or less than a prescribed amount, where the atmosphere temperature is equal to or higher than the prescribed temperature, and where the atmosphere humidity is higher than a prescribed humidity.

5. The image forming apparatus according to claim 4, wherein the rotation time from the timing that the fixing member reaches the warming up temperature where the atmosphere humidity is higher than the prescribed humidity, is longer than rotation time from a timing that the fixing member reaches the warming up temperature where the atmosphere humidity is equal to or lower than the prescribed humidity.

6. The image forming apparatus according to claim 4, wherein the rotation time setting unit compares a prescribed upper limitation value with a value calculated based on the atmosphere humidity detected with the environment value detection unit and on the lapse time result provided from the time measure unit, and sets the rotation time of the fixing member based on a compared result thereof.

7. The image forming apparatus according to claim 4, wherein the fixing member comprises a belt fixing member of a rotatable endless belt type, a heat dissipation member disposed on an inner periphery side of the belt fixing member in a manner contacting the belt fixing member, and a heat source using a resistor disposed in contact with the heat dissipation member.

8. The image forming apparatus according to claim 7, wherein the resistor is controlled with the temperature control unit.

9. The image forming apparatus according to claim 4, wherein the medium weight of the recording medium is 80 $g/m^2$ or less.

10. The image forming apparatus according to claim 4, wherein the rotation control unit controls the rotation of the fixing member in an idling state during the rotation time set with the rotation time setting unit.

11. An image forming apparatus for fixing, with heat and pressure, an image formed with a developer on a recording medium, comprising:

a fixing member rotatably supported for heating the developer;

a pressure member pressing the recording medium upon sandwiching the recording medium with the fixing member;

a temperature detection unit for detecting temperature of the fixing member;

a temperature control unit for controlling the temperature of the fixing member;

a rotation control unit for controlling rotation of the fixing member;

an environment value detection unit for detecting an atmosphere temperature and an atmosphere humidity;

a time measure unit for measuring time necessary for finish of warming up of the fixing member;

a rotation time setting unit for setting rotation time of the fixing member; and a medium information management unit for managing information on medium weight of the recording medium, wherein the rotation time setting unit changes the rotation time from a timing that the fixing member reaches a warming up temperature, based on a lapse time result provided from the time measure unit, in a case where the medium weight of the recording medium managed by the medium information management unit is equal to or less than a prescribed amount, where the atmosphere temperature is equal to or higher than a prescribed temperature, and where the atmosphere humidity is higher than a prescribed humidity.

12. The image forming apparatus according to claim 11, wherein the rotation time from the timing that the fixing member reaches the warming up temperature where the atmosphere humidity is higher than the prescribed humidity, is longer than rotation time from a timing that the fixing member reaches the warming up temperature where the atmosphere humidity is equal to or lower than the prescribed humidity.

13. The image forming apparatus according to claim 11, wherein the fixing member comprises a belt fixing member of a rotatable endless belt type, a heat dissipation member disposed on an inner periphery side of the belt fixing member in a manner contacting the belt fixing member, and a heat source using a resistor disposed in contact with the heat dissipation member.

14. The image forming apparatus according to claim 13, wherein the resistor is controlled with the temperature control unit.

15. The image forming apparatus according to claim 11, wherein the medium weight of the recording medium is 80 $g/m^2$ or less.

16. The image forming apparatus according to claim 11, wherein the rotation control unit controls the rotation of the fixing member in an idling state during the rotation time set with the rotation time setting unit.

* * * * *